US005309363A

United States Patent [19]

Graves et al.

[11] Patent Number: 5,309,363

[45] Date of Patent: May 3, 1994

[54] REMOTELY RECHARGEABLE POSTAGE METER

[75] Inventors: Frank M. Graves, 1930 Columbia Rd., NW., Washington, D.C. 20009-5026; Dale L. Magnusson, Annapolis, Md.

[73] Assignee: Frank M. Graves, Washington, D.C.

[21] Appl. No.: 846,167

[22] Filed: Mar. 5, 1992

[51] Int. Cl.[5] ..... G07B 17/00

[52] U.S. Cl. ..... 364/464.02; 235/380

[58] Field of Search ..... 235/380, 381, 382, 382.5; 364/464.02

[56] References Cited

U.S. PATENT DOCUMENTS

| | | | |
|---|---|---|---|
| 3,938,095 | 2/1976 | Check, Jr. et al. | 361/56 X |
| 4,097,923 | 6/1978 | Eckert et al. | 364/DIG. 2 |
| 4,122,532 | 10/1978 | Dlugos et al. | 364/DIG. 2 |
| 4,138,735 | 2/1979 | Allocca et al. | 364/DIG. 2 |
| 4,168,396 | 9/1979 | Best | 178/22 |
| 4,320,461 | 3/1982 | Dlugos | 364/466 |
| 4,325,440 | 4/1982 | Crowley et al. | 177/25 |
| 4,376,299 | 3/1983 | Rivest | 364/DIG. 2 |
| 4,376,981 | 3/1983 | Check, Jr. et al. | 364/570 |
| 4,395,756 | 7/1983 | Daniels | 364/DIG. 1 |
| 4,447,890 | 5/1984 | Duwell et al. | 364/DIG. 2 |
| 4,506,330 | 3/1985 | Dlugos | 364/466 |
| 4,524,426 | 6/1985 | Eckert et al. | 364/DIG. 2 |
| 4,535,421 | 8/1985 | Duwel et al. | 364/DIG. 2 |
| 4,549,281 | 10/1985 | Eckert et al. | 364/DIG. 2 |
| 4,556,944 | 12/1985 | Daniels et al. | 364/466 |
| 4,564,922 | 1/1986 | Muller | 364/DIG. 2 |
| 4,569,022 | 2/1986 | Coppola et al. | 364/466 |

(List continued on next page.)

OTHER PUBLICATIONS

U.S. Postal Service Annual Report, 1989, p. 8.

Computerized Meter Resetting System, Handbook F-51, U.S. Postal Service, Dec. 20, 1986.

Pitney Bowes Eagle Personal Mailing System, AD10827 R1(92), brochure, 1990.

Pitney Bowes Computerized Meter Resetting System (CMRS), Three-fold type brochure, Feb. 1992.

Dowdell Pitney Bowes Modular Mailing Systems Model 6220, P.B. Cat. No. M-43, Feb. 1992.

Ascom Hasler AG Mailmaster, brochure, Feb. 1992.

Dowdell Pitney Bowes Modular Mailing Systems 6200 Series, PB Cat. No. M-45 brochure, Feb. 1992.

Francotyp POSTALIA, Top Tour, brochure, Feb. 1992.

Alcatel Friden, Form 80455 brochure, Mar. 1992.

Pitney Bowes Modular Mailing Systems 6200 Series, PB Cat. No. M-66 brochure, Feb. 1992.

*Primary Examiner*—Edward R. Cosimano

*Attorney, Agent, or Firm*—Staas & Halsey

[57] ABSTRACT

A postage meter and system is provided for recharging the postage meter using a credit card number via communication over a modem with a manufacturer host. The postage meter has a nonvolatile register indicating an amount of postage resident in the postage meter. An account number register stores at least one credit card number which can be used for remote recharging of the postage meter. A constant nonvolatile register indicates a postage meter number permanently assigned to the postage meter. A modem in the postage meter transmits the credit card number and the postage meter number to the manufacturer host when requesting an increase in the amount of the postage resident in the postage meter. When the manufacturer host receives the request from the postage meter, the manufacturer host verifies that the postage meter number is among a list of valid postage meter numbers. Then the manufacturer host verifies that the credit card number is valid and creditworthy by confirmation via a modem or, alternatively, by using a list of valid account numbers stored therein.

25 Claims, 18 Drawing Sheets

U.S. PATENT DOCUMENTS 4,573,174 2/1986 Crowley et al. ..... 377/39
4,574,352 3/1986 Coppola et al. ..... 364/466
4,584,648 4/1986 Dlugos ..... 364/466 X
4,595,984 6/1986 Daniels ..... 364/466
4,603,400 7/1986 Daniels ..... 364/DIG. 2 X
4,618,953 10/1986 Daniels et al. ..... 371/12
4,783,745 11/1988 Brookner et al. ..... 364/464.02
4,811,234 3/1989 Storace ..... 364/464.02
4,812,965 3/1989 Taylor ..... 364/550
4,812,994 3/1989 Taylor et al. ..... 364/464.02
4,829,469 5/1989 Germaine et al. ..... 364/DIG. 2 X
4,831,554 5/1989 Storace et al. ..... 364/464.02 X
4,864,506 9/1989 Storace ..... 364/464.02
4,978,839 12/1990 Chen et al. ..... 235/375
4,980,542 12/1990 Jackson et al. ..... 235/375
4,998,203 3/1991 DiGiulio et al. ..... 364/464.02
5,010,568 4/1991 Merriam et al. ..... 379/101
5,020,429 6/1991 Riley et al. ..... 101/93
5,021,963 6/1991 Brown et al. ..... 364/464.02
5,025,383 6/1991 Haines et al. ..... 364/464.03
5,025,386 6/1991 Pusic ..... 364/478
5,077,792 12/1991 Herring ..... 364/464.02 X
5,202,834 4/1993 Gilham ..... 364/464.03 X
5,233,532 8/1993 Ramsden ..... 364/464.02 X

200

260

270

REMOTELY RECHARGEABLE POSTAGE METER

BACKGROUND OF THE INVENTION

1. Technical Field

The present invention relates to a postage meter capable of remote recharging and, more particularly, relates to a postage meter system for electronically recharging a postage meter from a remote location.

2. Description of the Related Art

Postage meters conventionally operate with at least two internal accounts or registers for recording postage. One of the internal registers is a descending balance that shows the amount of postage available for use. Another of these registers is an ascending balance that shows the amount of postage that has ever been printed by the meter. The sum of the descending balance and the ascending balance must remain constant between recharging of the amount of money resident in the postage meter for distribution as postage. In mechanical meters, cogged wheels with digits on their rim surfaces similar to the odometer in a vehicle serve as the balance accounting mechanism. In electronic postage meters these mechanical wheels have been replaced with nonvolatile memories, the balance contained in the nonvolatile memory being displayable on an electronic display.

Conventional postage meters must be physically carried to a local supervising post office, station, or branch so that they can be recharged with money for distribution as postage. At the local supervising post office a clerk first verifies that there is no sign of tampering with the postage meter, then the clerk adds the ascending balance and the descending balance to determine a value of new postage which was previously loaded into the postage meter. This amount is compared with the amount of postage purchased that was recorded in a post office log book at the time that the meter was previously recharged. If the two amounts agree, additional postage is then loaded into the postage meter and payment is made to the clerk at that time.

Remotely rechargeable postage meters have previously been proposed. In such postage meters a meter user or licensee obtains additional postage by telephone to access a prepaid bank account of the user or licensee which is held in escrow. However, this arrangement requires the forethought of a prepaid bank account. Furthermore, the funds in the prepaid bank account do not draw interest for the meter user or licensee. Additionally, the meter user must predict, in advance, an amount of funds which will be needed in the prepaid bank account so that they will be available upon demand. Thus, the prepaid bank account is inflexible and difficult to use by users who have an unpredictable amount of mail to process. Furthermore, such prepaid bank account requires an overhead which small businesses may not be willing to undertake.

SUMMARY OF THE INVENTION

An object of the present invention is to provide a postage meter which is remotely resettable without the requirement of a prepaid bank account.

Another object of the present invention to provide a postage meter which is remotely resettable on demand.

A further object of the present invention is to provide a postage meter which is remotely resettable on demand at any time.

An additional object of the present invention is to provide a postage meter which is remotely resettable without having to predict an amount of postage which will be needed in the near future.

It is an additional object of the present invention to provide a postage meter which can be remotely reset by an account which has not been previously approved by either the post office or meter recharging system.

It is a further object of the present invention to provide a postage meter which can be remotely recharged by virtually an unlimited number of accounts.

It is an additional further object of the present invention to provide a postage meter which can be recharged on a user's credit.

It is another object of the present invention to provide a postage meter which can be remotely recharged using any commercial credit card.

It is still another object of the present invention to provide a postage meter in a system which automatically transfers funds to a U.S. Postal Service bank account at the time of remote recharging.

It is still a further object of the present invention to provide a postage meter and system for remotely recharging the meter based on a credit authorization approval that is obtained over a financial network from a credit card service company.

In the present invention a postage meter is provided which can be remotely recharged via communication over a modem with a manufacturer host. A nonvolatile register indicates an amount of money resident in the postage meter. The postage meter has a constant nonvolatile register for indicating a postage meter number permanently assigned to the postage meter. An account number register stores at least one account number, such as a credit card number, which can be used for remote recharging of the meter. A modem in the postage meter transmits the account number and the postage meter number to the manufacturer host when requesting an increase in the amount of money resident in the postage meter.

The manufacturer host has a meter number register storing a list of valid postage meter numbers. When the manufacturer host receives a request from a postage meter to increase an amount of money resident in the postage meter, the manufacturer host verifies that the postage meter number is among valid postage meter numbers stored in the meter number register. Then the manufacturer host verifies that the account number transmitted over a modem from the postage meter to the manufacturer host is a valid account number. The manufacturer host verifies that the account number is valid by, in one embodiment, confirming via modem over a financial network that the account number is valid. For example, the manufacturer host can contact a credit card service company to confirm the creditworthiness of an account of a credit card number and receive a credit authorization approval code word therefrom. In an alternative embodiment, the manufacturer host has an account number register which stores a list of valid accounts such as credit card accounts. The arrangement of this alternative embodiment would have the efficiency of eliminating the credit card service company in the event the manufacturer operating the host also has issued credit cards which can be used as an account for remotely recharging a postage meter.

The above-mentioned and other objects and features of the present invention will become apparent from the following description when read in conjunction with the accompanying drawings.

BRIEF DESCRIPTION OF THE DRAWINGS

FIG. 7(*b*) illustrates a schematic diagram of an interface of a mother board expansion bus to address and data circuitry for a construction of the postage meter of the present invention;

FIG. 7(*c*) illustrates a schematic diagram of circuitry for connection to a nonvolatile memory in a construction of the postage meter of the present invention;

FIG. 7(*d*) illustrates a schematic diagram of circuitry for connection to a display in a construction of the postage meter of the present invention;

DETAILED DESCRIPTION OF THE PREFERRED EMBODIMENTS

Figure 1:
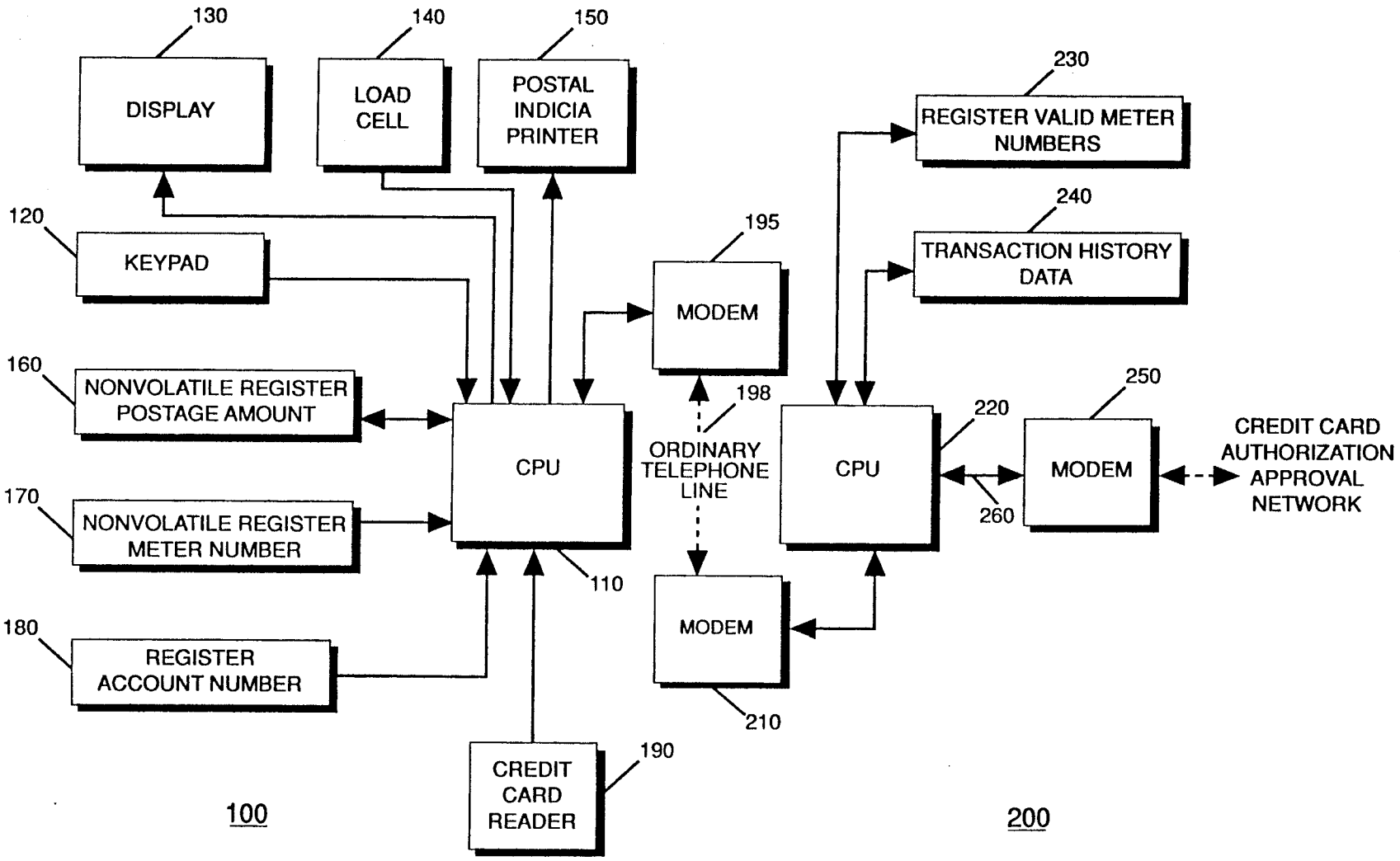
FIG. 1 illustrates a schematic block diagram of a postage meter recharging system which illustrates an exemplary postage meter and the manufacturer host.

FIG. 1 illustrates a schematic diagram of the postage meter system of the present invention. An electronic postage meter EPM 100 has a central processing unit CPU 110 connected to a keypad 120 and a display 130 to provide a user interface for the postage meter. A load cell 140 is connected to the central processing unit 110 to indicate a weight of a package or letter to be mailed. A postal indicia printer 15 is attached to the central processing unit 110 to print postage labels or postage directly on the packages or envelopes weighed on the load cell 140. A nonvolatile register 160 is connected to the central processing unit 110 to store an amount of money resident in the postage meter. A constant nonvolatile register 170 is connected to the central processing unit 110 to store a unique meter number assigned to the postage meter. The constant nonvolatile register 170 preferably is a read only memory (ROM), or a programmable read only memory (PROM) permanently preprogrammed by the manufacturer with the postage meter number. The nonvolatile register 160 is preferably an electronically erasable programmable read only memory (EEPROM) or a battery backup RAM which can store the amount of postage (in dollars or other monetary units) in the meter without data loss due to power failure or the like. However, unlike the read only memory of the nonvolatile register 160, the electronically erasable read only memory of the constant nonvolatile register 170 can be decremented by the central processing unit 110 as postage is dispensed by the postal indicia printer 150. Two registers, an ascending register and a descending register, can be provided by the electronically erasable read only memory to store the dollar amount. The nonvolatile register 160 may be implemented by a hard disk drive under exclusive control of the central processing unit 110. However, the nonvolatile register 160, however implemented, must be inaccessible to the user of the postage meter to prevent tampering and fraudulent alteration of the dollar amount stored in the nonvolatile register 160. However, it can be appreciated that certain types of memory, for example, flash memory, can be used to function as any of the above mentioned.

A register 180 to store at least one account number is also connected to the central processing unit 110. The register 180 can be a RAM, hard disk drive or even the electronically erasable read only memory. Because the register 180 stores at least one account number which can be altered by the user of the postage meter, the data in register 180 should be accessible and alterable by the user of the postage meter so that new accounts can be added and old accounts deleted by the user.

A credit card reader 190 is also attached to the central processing unit 110 for reading account numbers from a credit card and storing them in the register 180. The credit card reader preferably is a conventional credit card magnetic strip reader. A modem 195 is also attached to the central processing unit 110 for communication over an ordinary telephone line 198 to a manufacturer host 200. When the user of the postage meter 100 desires to add an amount of money stored in the nonvolatile register 160, commands are input on the keypad 120 to increase the amount of money. The modem 195, under control of the processing unit 110, then transmits from the postage meter 100 to the manufacturer host 200 the meter number stored in the nonvolatile register 170. A modem 195 also transmits to the manufacturer host 200 a particular one of the at least one account numbers stored in the register 180. After an authorization approval is received from the manufacturer host 200 by the modem 195 of the postage meter 100, the CPU 110 commands the nonvolatile register 160 to increase the dollar amount therein.

The manufacturer host 200 has a modem 210 which connects by the ordinary telephone line 198 to the modem 195 of the postage meter 100. A central processing unit 220 of the manufacturer host 200 reads and writes from a register 230 of valid meter numbers and stores transaction history data in register 240. The central processing unit 220 also connects via a link 260 to a modem 250 of the manufacturer host 200 for communication with a financial network over an ordinary telephone line, for example, or by a dedicated telephone line, a fiber optic data highway or by satellite or microwave transmitter, for further examples. The link 260, for example, can be a connection to a data service such as BT TYMNET ® or other communications network such as that of Control Data Corporation (CDC), MCI ® or AT&T ®. The modem 250 of the manufacturer host, in a preferred embodiment, connects to a credit card authorization network for determining the validity and creditworthiness of credit card numbers.

When the manufacturer host 200 receives a request from a postage meter 100 to increase an amount of money resident therein, the manufacturer host 200 compares the meter number received by modem 210 with a list of valid postage meter numbers stored in the register 230 of the manufacturer host. Then, the manufacturer host 200 sends the account number received by modem 210 from the postage meter by modem 250 over the link 260 for verification by the financial network. After the account number is verified by the financial network, the manufacturer host 200 receives a verification over modem 250 from link 260. Then the central processing unit 220 of the manufacturer host 200 sends an authorization approval via modem 210 to the postage meter 100 to increase the postage amount in the nonvolatile register 160 of the postage meter 100. The manufacturer host 200, under control of the central processing unit 110, also stores a record of the authorization approval in the transaction history data register 240. In the event the financial network sends a signal of nonverification or noncreditworthiness to the modem 250 of the manufacturer host 200 over the link 260, the central processing unit 220 also stores in the transaction history data register 240 a record of a denial of a request for an increase in an amount of money resident in postage meter 110.

Figure 2:
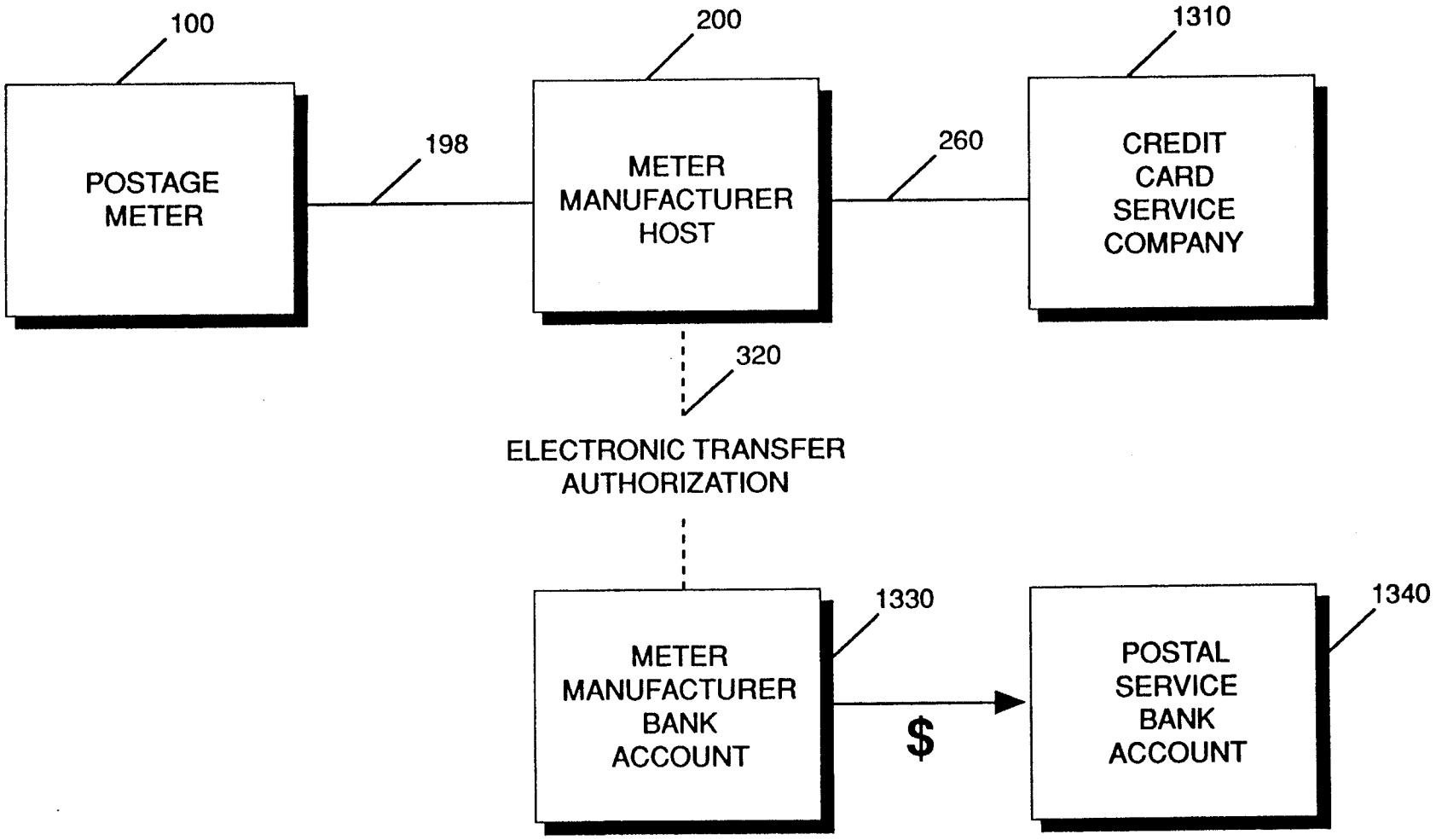
FIG. 2 illustrates a schematic block diagram of another embodiment of a postage meter recharging system for recharging a postage meter.

FIG. 2 illustrates a system block diagram for recharging the electronic postage meter 100 via the manufacturer host 200. The manufacturer host 200 communicates over the link 260 with the host of a credit card service company 1310. Therefore, when the postage meter 100 sends a credit card number as the account number to the manufacturer host 200 for an increase in an amount of money resident in the postage meter, the manufacturer host 200 sends the credit card number via the link 260 to the host of the credit card service company 310. The credit card service company may be a service bureau or a card issuing institution itself. The manufacturer host 200 also transmits over link 260 to the credit card service company 310 an expiration date for the credit card and an amount of money requested to be charged. The credit card service company 1310 then checks its records of validity and creditworthiness against these data to determine if an authorization for the charge should be given. If an authorization is given, the credit card service company 310 sends an authorization approval code to the manufacturer host 200. The credit card service company 1310 is a conventional electronic credit clearing house which receives thousands of credit authorization approval requests from various merchants such as gas stations, department stores, or the like throughout the country. The credit card service company 1310 compares the credit card number with clearing house data such as that for Visa ®, MasterCard ®, American Express ®, Discover ® or like credit cards and returns a credit authorization approval including a credit authorization approval code. The manufacturer host 200 then stores the credit authorization approval code in the transaction history data register 240.

When the manufacturer host 200 receives an authorization approval from the credit card service company 1310, the manufacturer host can then, in real time, request over link 1320 an electronic transfer of funds from a manufacturer's bank account 1330 to a U.S. Postal Service bank account 1340. Therefore, the postal service can receive immediate funding for postage added to the postage meter 100 even though the postage is purchased on credit extended from any of a number of credit cards or accounts having numbers stored in the postage meter 110. The risk of payment of the debt on the credit card rests with the financial community including the credit card company or the manufacturer, but using the above-described manufacturer host 200, the risk does not rest on the Postal Service because payment is immediately made to the Postal Service bank account 1340. Alternatively, rather than transferring to the Postal Service bank account 1340 on a real time basis, the manufacturer host 220 can, at predetermined intervals of time, transfer funds based upon the record of transactions stored in the transaction history data register 240. Under such a scenario, transfers to the Postal Service bank account can occur once every minute, hour, or each calendar day, business day, or banking day, for example, in the middle of the night during nonpeak periods.

Figure 3:
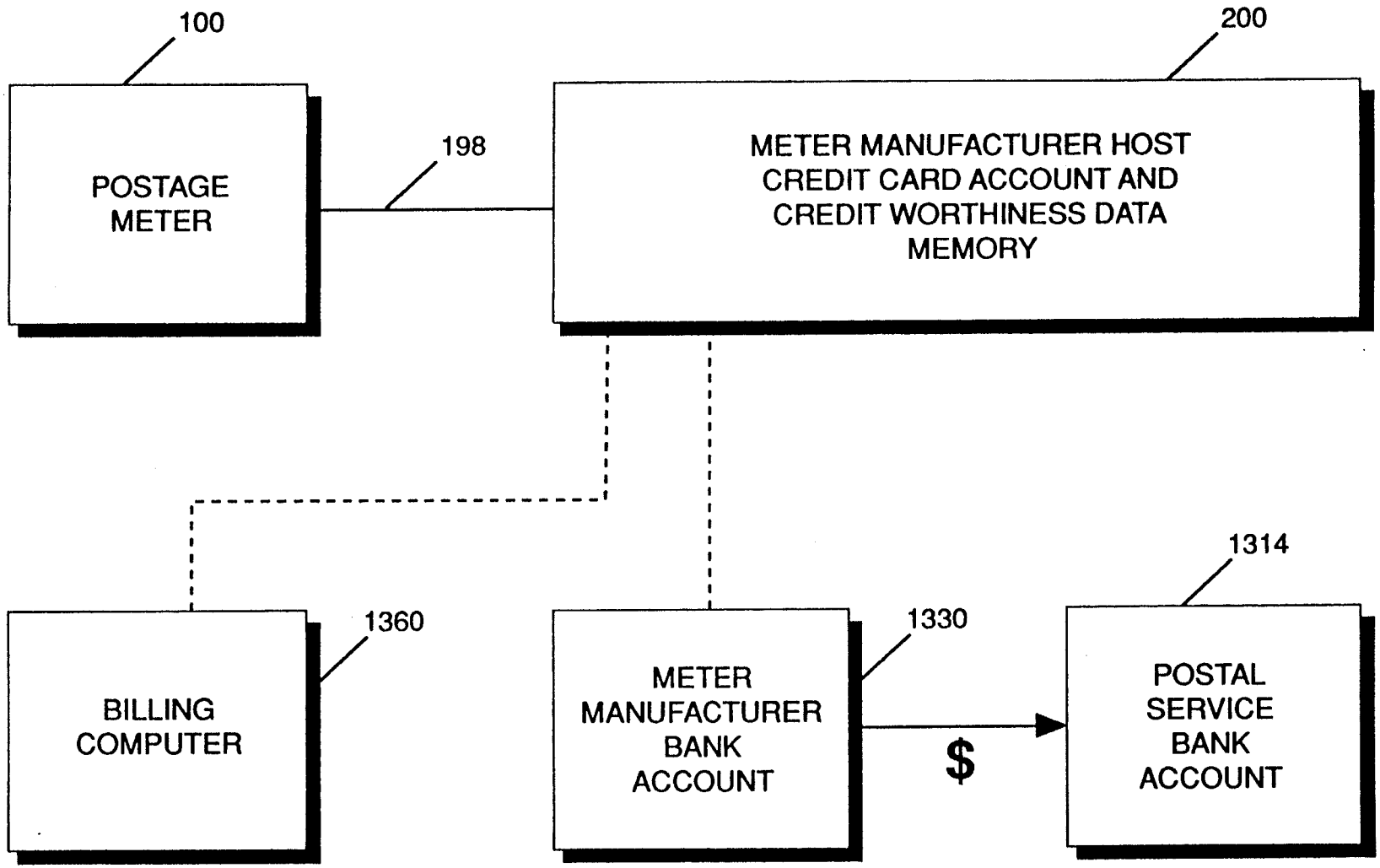
FIG. 3 illustrates a schematic block diagram of an additional embodiment of a postage meter recharging system for recharging a postage meter.

FIG. 3 illustrates a schematic block diagram of a postage meter system for recharging the postage meter 100. In the system of FIG. 3 the manufacturer host 200 includes the credit card account and creditworthiness information in a credit card service authorization data memory. Therefore, credit card authorization approvals can be provided in the manufacturer host without communication on the link 260 with the financial community such as, for example, the credit card service company 310. Such would be advantageous when, for example, the manufacturer operating the manufacturer host 200 owns or operates the accounts or credit cards used for authorizations used for addition of postage to the postage meters. Automatic transfer of funds to a postal service bank account 340 can still occur on a real time basis or automatically, as desired. Furthermore, the host manufacturer 200 can transmit the records stored in the transaction history data register 240 to a billing computer 1360. Then, the billing computer 1360 can sort the charges and print periodic statements or bills on, for example, a monthly basis.

Figure 4A:
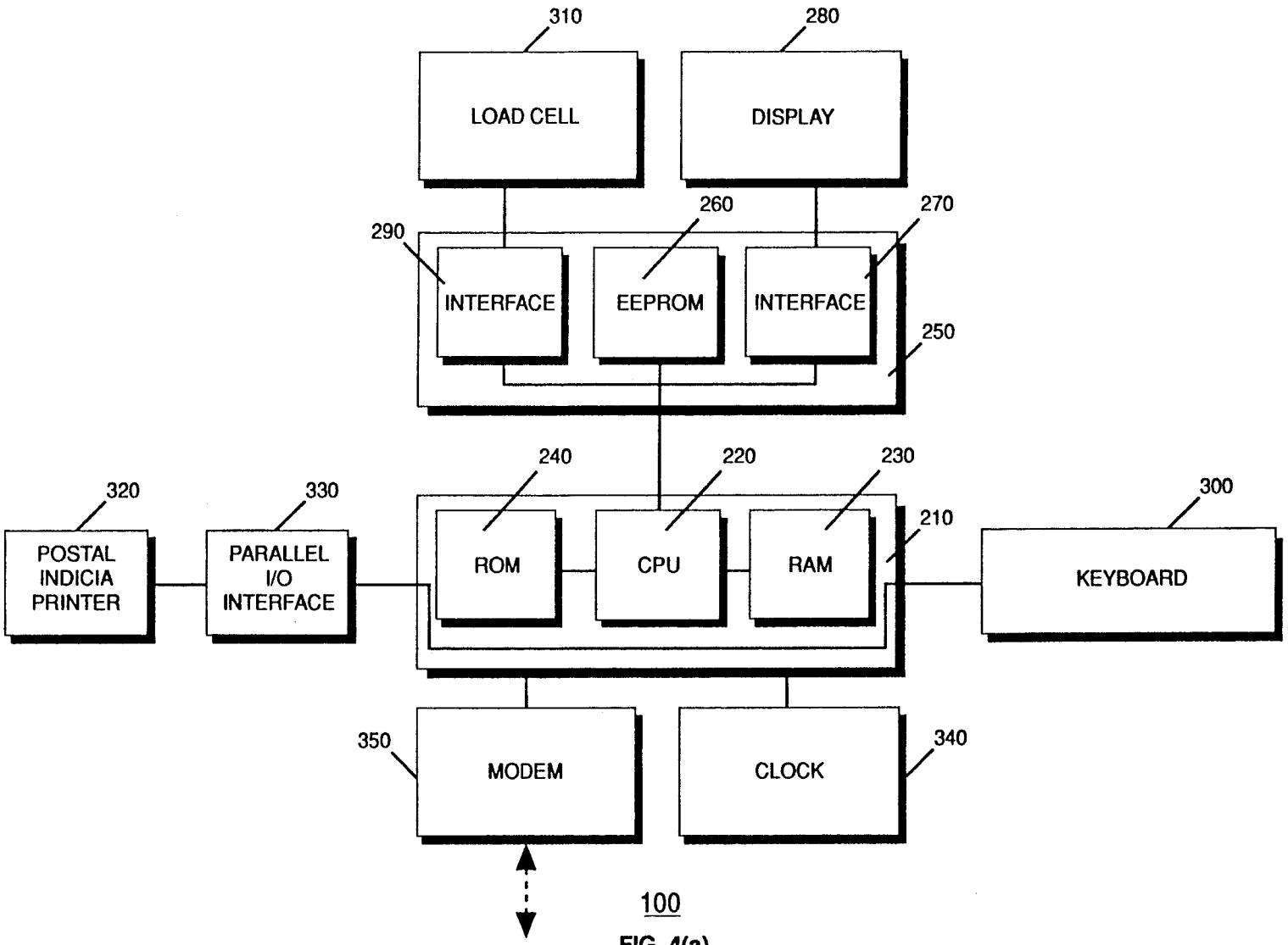
FIGS. 4(*a*) and 4(*b*) illustrate schematic block diagrams of the components of a postage meter according to two constructions of the present invention.
Figure 4B:
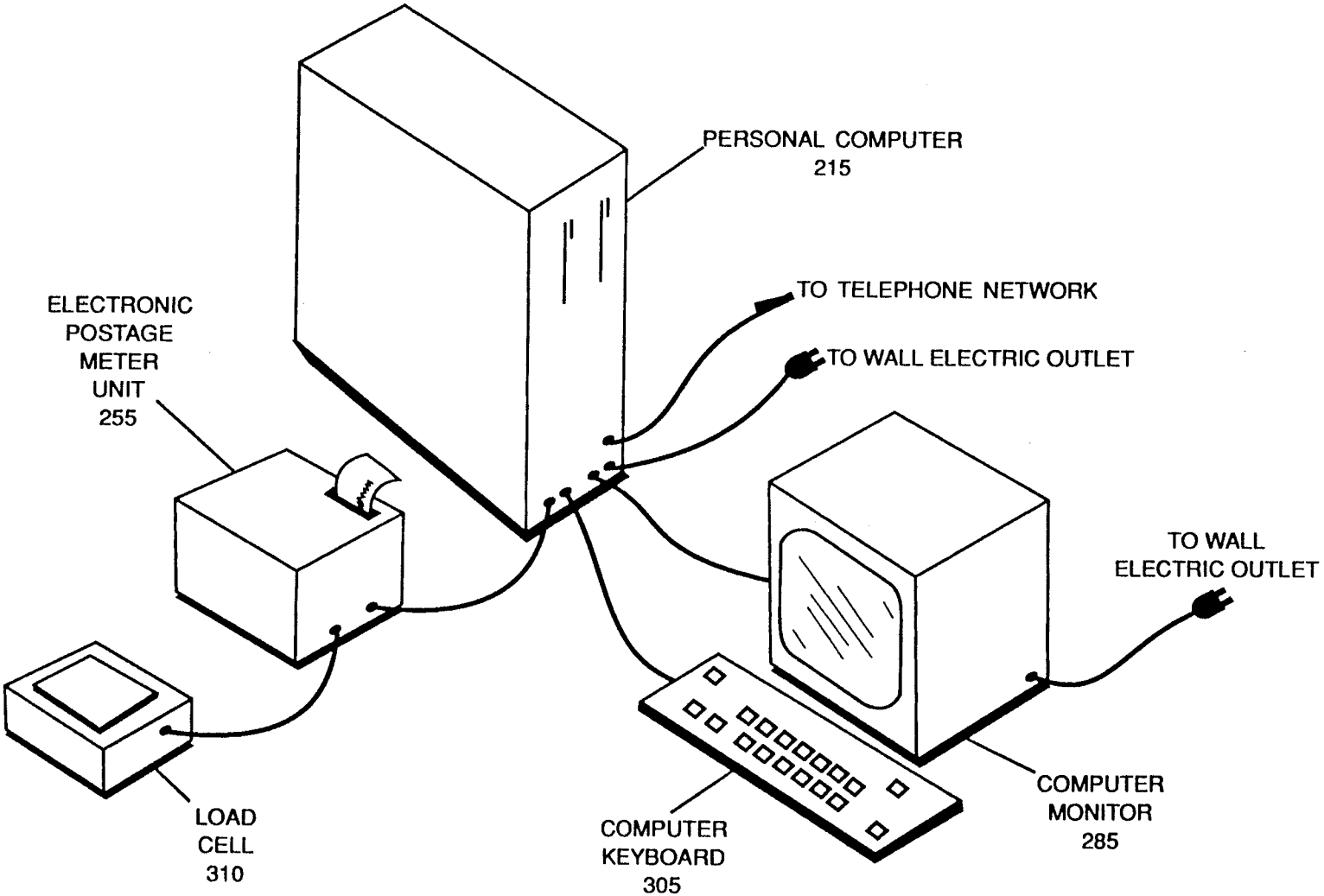

FIG. 4(*a*) illustrates a construction of the postage meter of the present invention. A mother board 210 contains a central processing unit CPU 220. The mother board 210 also contains a random access memory RAM 230 to store temporary data and the results of calculations and a read only memory ROM 240 for containing the operating system control program for the mother board 210. Furthermore, the read only memory 240 can store program information for controlling the central processing unit 220 to perform the operations of the postage meter including recharging the postage meter with an amount of postage. In a preferred construction the mother board 210 can be a mother board from a conventional IBM ® personal computer (PC) having an interface board 250 plugged into an expansion slot thereof. In this construction the interface board 250 can contain an electronically erasable programmable read only memory EEPROM 260, a display interface 270 and a load cell interface 290. Further details of the interface board 250 will be described below with reference to FIGS. 6 and 7(*a*)–7(*d*).

The electronically erasable programmable read only memory 260 contains the descending and ascending balances which indicate an amount of postage resident in the postage meter. A display 280, preferably a small liquid crystal display (LCD) or light emitting diode (LED) display to save cost, is used. However, it is possible that other displays such as a cathode ray tube can be used. A keyboard 300 is also attached to the mother board 210. The keyboard 300 is preferably an alphanumeric keyboard such as that from a conventional IBM ® personal computer or equivalent. However, the keyboard can be any conventional alphanumeric keyboard. Furthermore, to save cost, the keyboard 300 can be a small keypad including various numbers and function keys thereon. The display 280 and the keyboard 300 can work together for control in response to a menu driven display by the user. The user selects and presses a function key on the keyboard 300, causing display 280 to display an associated menu from which the user may then select an option by pressing the Y key (YES) or by scrolling further through a menu and again pressing a function key.

A load cell 310 is also connected to the interface board 250. The load cell, preferably, can weigh packages up to fifty pounds and can achieve reliable linearity for both heavy and light weight parcels or letters.

A postal indicia printer 320 is connected via a parallel input/output interface 330 to the mother board 210. A postal indicia printer 320 can be a dot matrix thermal printer or a dot matrix film or ribbon printer. Additionally, a dot matrix thermal or dot matrix film or ribbon printer can be combined with a conventional printing plate whereby the variable information is printed by the dot matrix thermal or dot matrix film or ribbon printer, and the fixed information (postage validation mark, distinctive border design, and meter number). A clock 340 can also be provided connected to the mother board 210. However, the clock 340 may also be inherent in the components of an off-the-shelf mother board like mother board 210. Furthermore, a modem 350 is connected to the mother board 210 for communication with the manufacturer host to receive an authorization approval to increase an amount of postage resident in the postage meter.

A special read only memory 240 programmed by the manufacturer can provide instructions for the central processing unit 220 for operation of the postage meter. A primary password stored in the read only memory 240 can control access to all of the postage meter functions including loading or changing basic data such as meter licensing information, which includes but is not limited to the name, street address, and telephone number of the licensee, the address and telephone number at which the electronic postage meter is located, and the name and address of the post office, station, or branch which is to supervise the postage meter. The meter licensing information can also include the licensee's card number or numbers and date of expiration and even any of the licensee's debit card number or numbers. Furthermore, it can contain the telephone number that the postage meter will automatically dial via the modem 350 in order to purchase new postage by credit card number or debit card transaction.

The electronic postage meter can be remotely licensed or registered into service, have its license renewed or be relicensed via the keyboard 300 and display 280 under control of the central processing unit 220 based on a program in the read only memory 240. For licensing or registering into service, the user or licensee of the postage meter is prompted to enter licensing information, such as that described above, via keyboard 310. Thereafter, the modem 350 of the postage meter will automatically dial a preprogrammed telephone number. This preprogrammed telephone number can be the same telephone number of the manufacturer host as required for an authorization of an increase in an amount of postage resident in the postage meter. When the manufacturer host 200 receives a request for remote licensing or registration, the manufacturer host can connect to a host of the New York Postal Data Center, for example, which is a repository of meter licensing data.

One or more secondary passwords can also be implemented, including new passwords input for use by the user or employees of the user. These passwords can be stored in the RAM 230 or in the electronically erasable programmable read only memory 260. The electronically erasable programmable read only memory 260 can be replaced by a battery backup random access memory or even a flash memory which has a constant storage capacity without loss of data due to power failure or the like. Furthermore, if the postage meter is programmed to prevent access by the user to certain sectors of a hard drive, a hard drive may be used to replace the electronically erasable programmable read only memory or one of the battery backup random access memory.

FIG. 4(*b*) illustrates a construction of the postage meter of the present application using an IBM ® personal computer 215, a monitor display 285, a qwerty keyboard 305 and a separately housed electronic postage meter unit 255. The modem 350 is housed in the personal computer 215 by connection to a slot on the mother board inside the housing of the personal computer 215. Thus, a personal computer such as an ordinary IBM ® personal computer or equivalent 215 having a compatible internal (or external) modem, a conventional personal computer monitor 285 and keyboard 305 can be used with the electronic postage meter unit 255. Thus in the present invention, the many existing owners of personal computers can add a postage meter thereto with little additional cost or effort.

In the embodiment using a conventional personal computer of FIG. 4(*b*), an electronically erasable programmable read only memory (EEPROM) is provided in the separately housed electronic postage meter unit 255. This electronically erasable read only memory is analogous to electronically erasable programmable read only memory 260 in FIG. 4(*1*). The electronically erasable programmable read only memory is used for storing the amount of postage (money) resident in the postage meter for dispensing as postage. Furthermore, the meter number of the electronic postage meter is preferably stored in a read only memory or other nonerasable memory in the housing of the electronic postage meter unit 255. The meter number and amount of postage resident in the meter are stored in the electronic postage meter 255, rather than the personal computer 215, to prevent tampering and fraud.

A load cell 310 in FIG. 4(*b*) can be coupled to the separately housed electronic postage meter unit 255. However, it is possible that the load cell 310 is formed integrally within the housing of the electronic postage meter unit 255. Additionally, it is possible that the load cell 310 connects directly to the housing of the personal computer 215.

Figure 5:
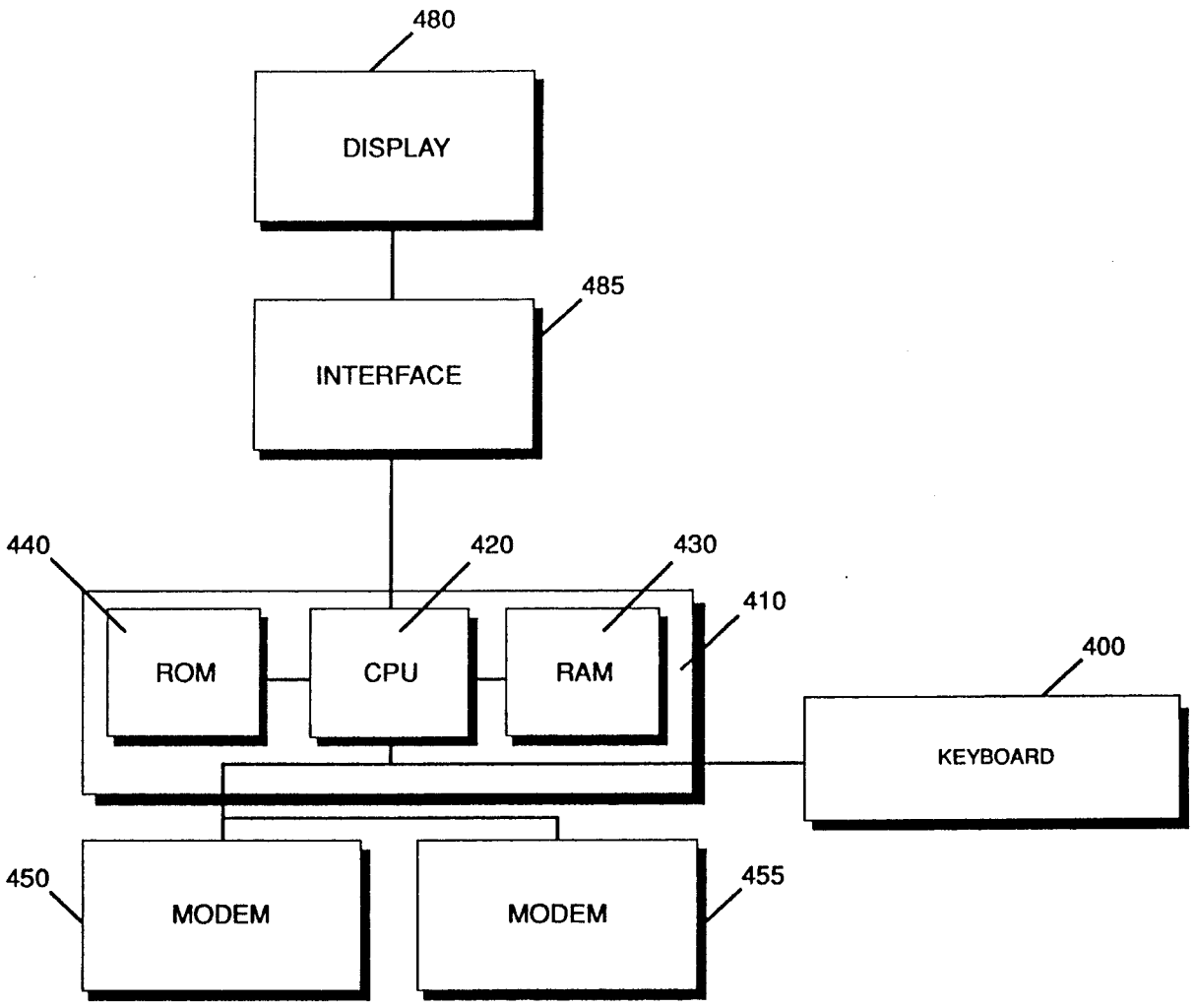
FIG. 5 illustrates a schematic block diagram of components of the manufacturer host.

FIG. 5 illustrates a schematic block diagram of the manufacturer host of the present invention. The manufacturer host can be constructed using a conventional IBM ® personal computer mother board 410 having a central processing unit 420, a random access memory 430 and a read only memory 440. A display 480 can be connected by a display interface 485 to the mother board 410. A plurality of modems, for example, modems 450 and 455, can be connected to the mother board 410 as can a keyboard 400. Thus, the manufacturer host can be constructed very much like the postage meter described above in FIG. 4. However, if a large number of postage meters are serviced by the manufacturer host, a mother board other than the mother board 410 of a conventional IBM ® personal computer is preferred. Furthermore, depending upon a peak number of postage meters telephoning the manufacturer host 200, a selected number of one or more modems will be desired.

Figure 6:
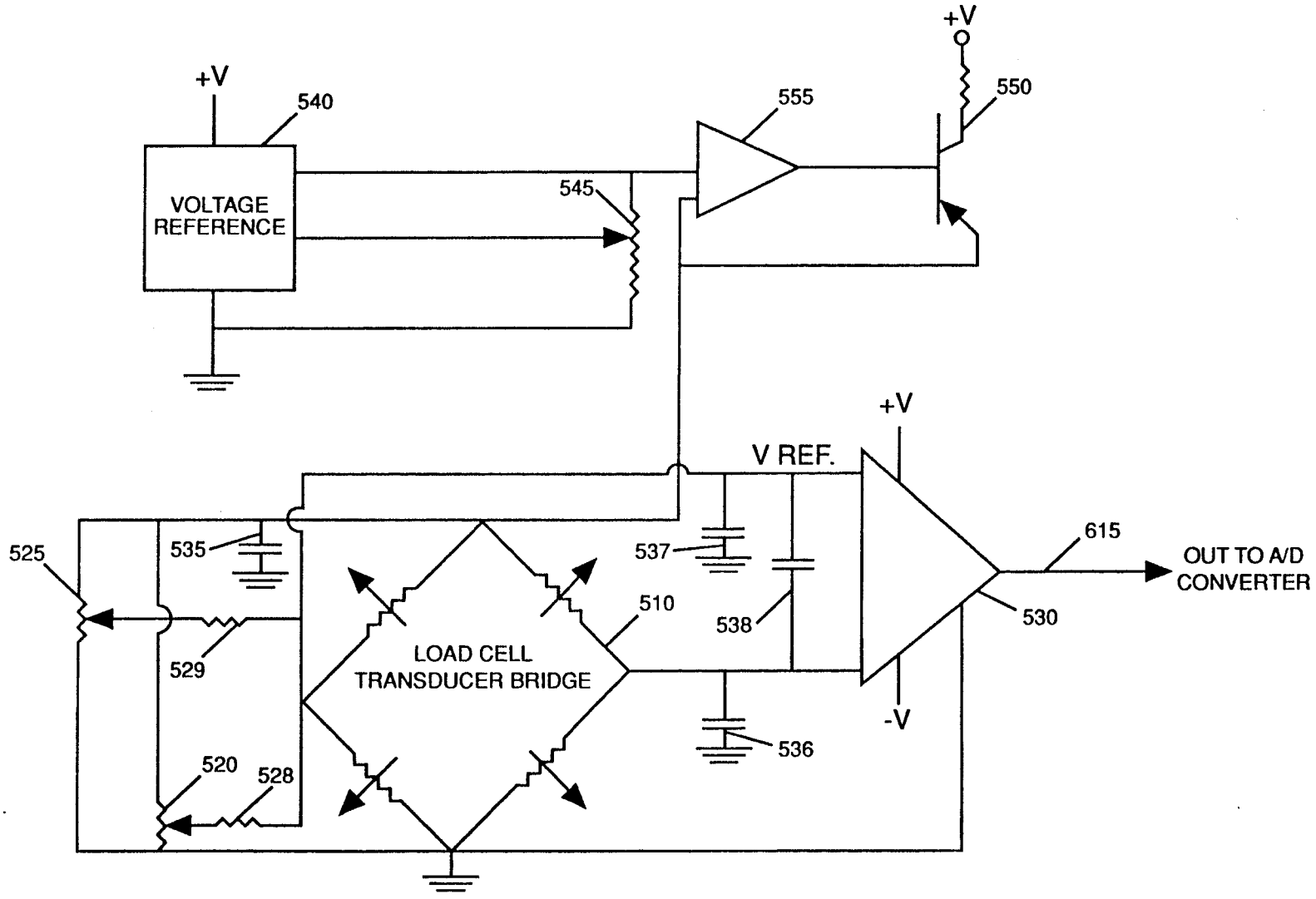
FIG. 6 illustrates a schematic diagram of interface circuitry to a load cell in a construction of the postage meter.
Figure 7A:
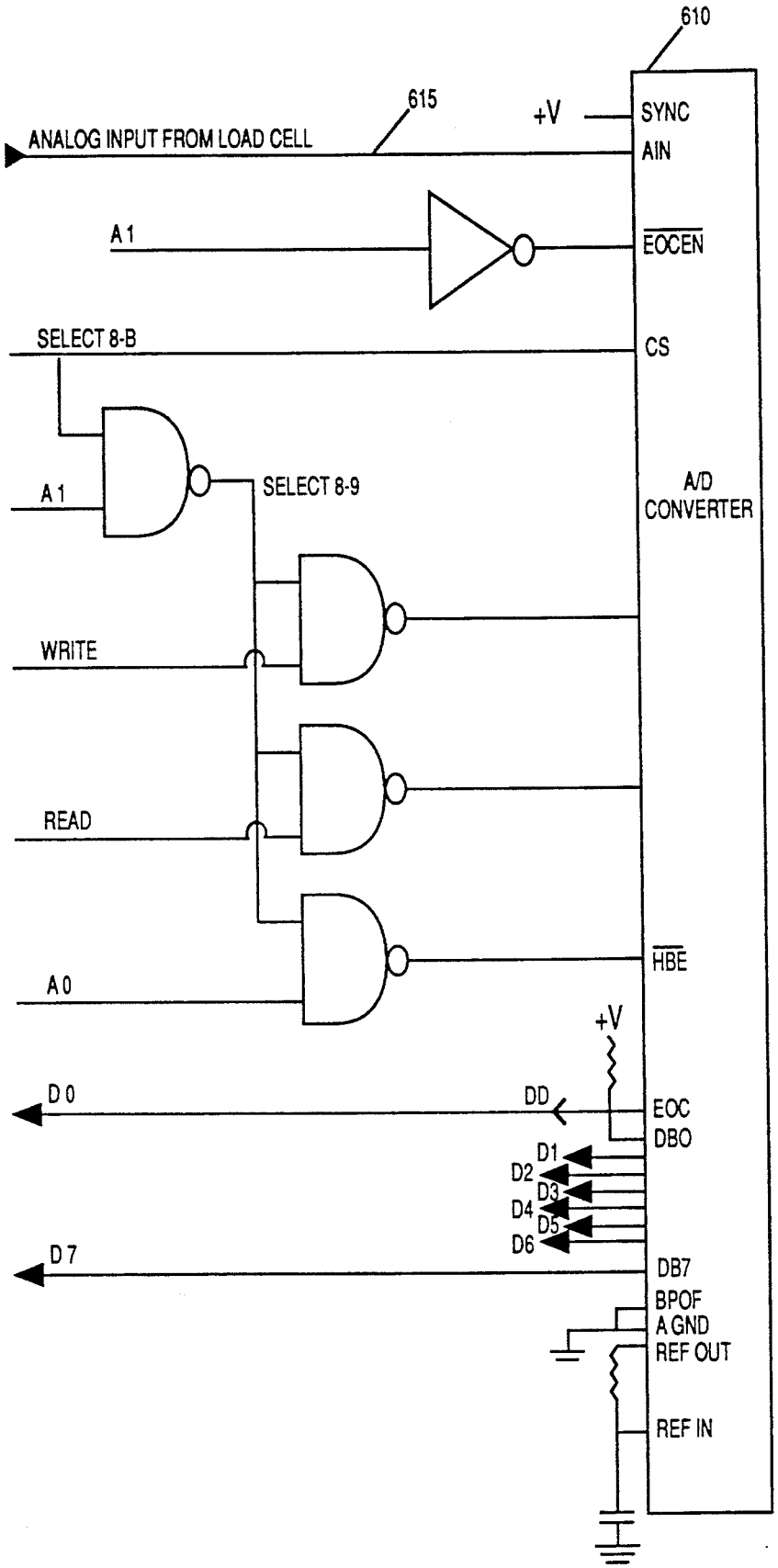
FIG. 7(*a*) illustrates a schematic diagram of circuitry for an interface of an analog to digital converter to a load cell of the present invention.
Figure 7B:
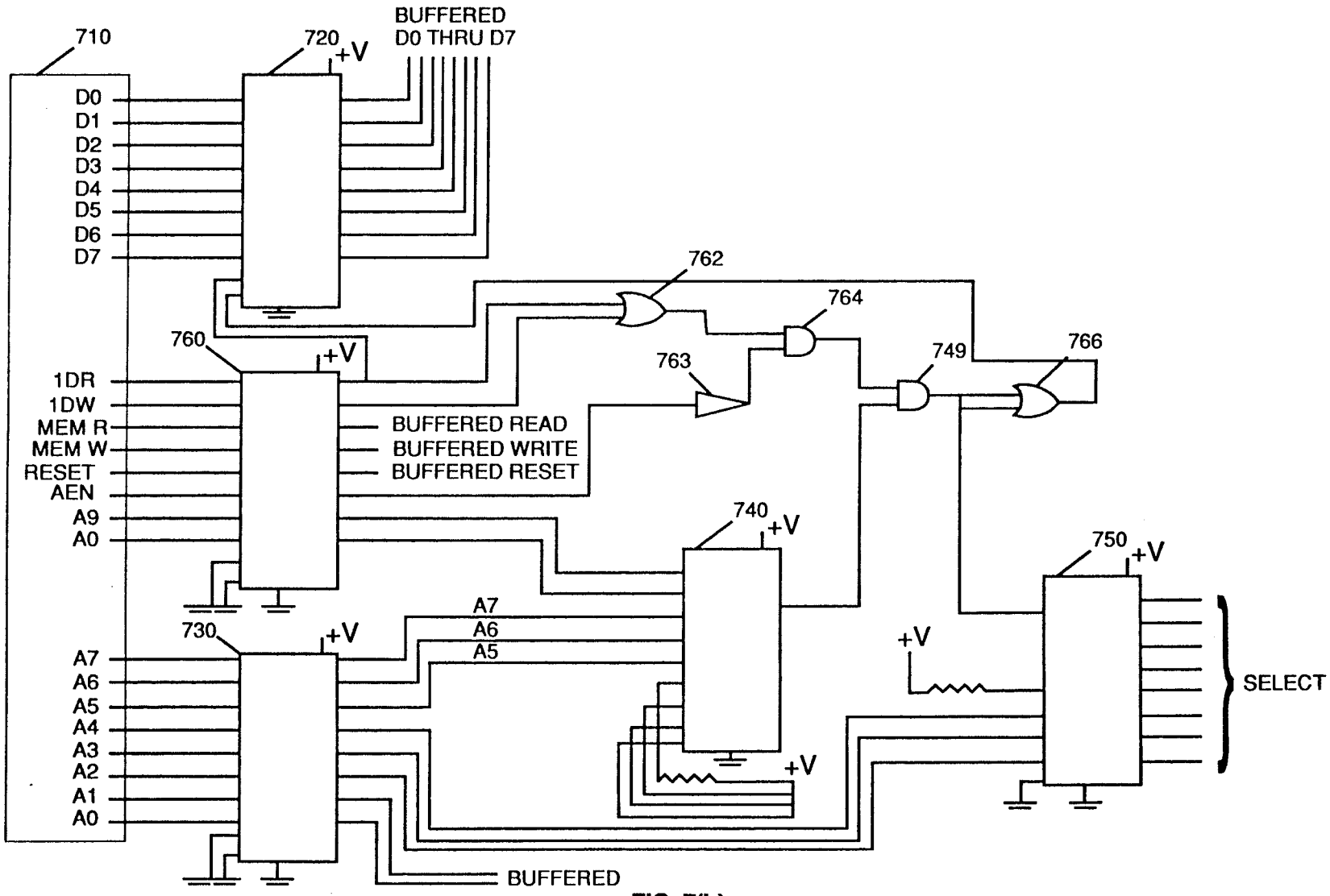
Figure 7C:
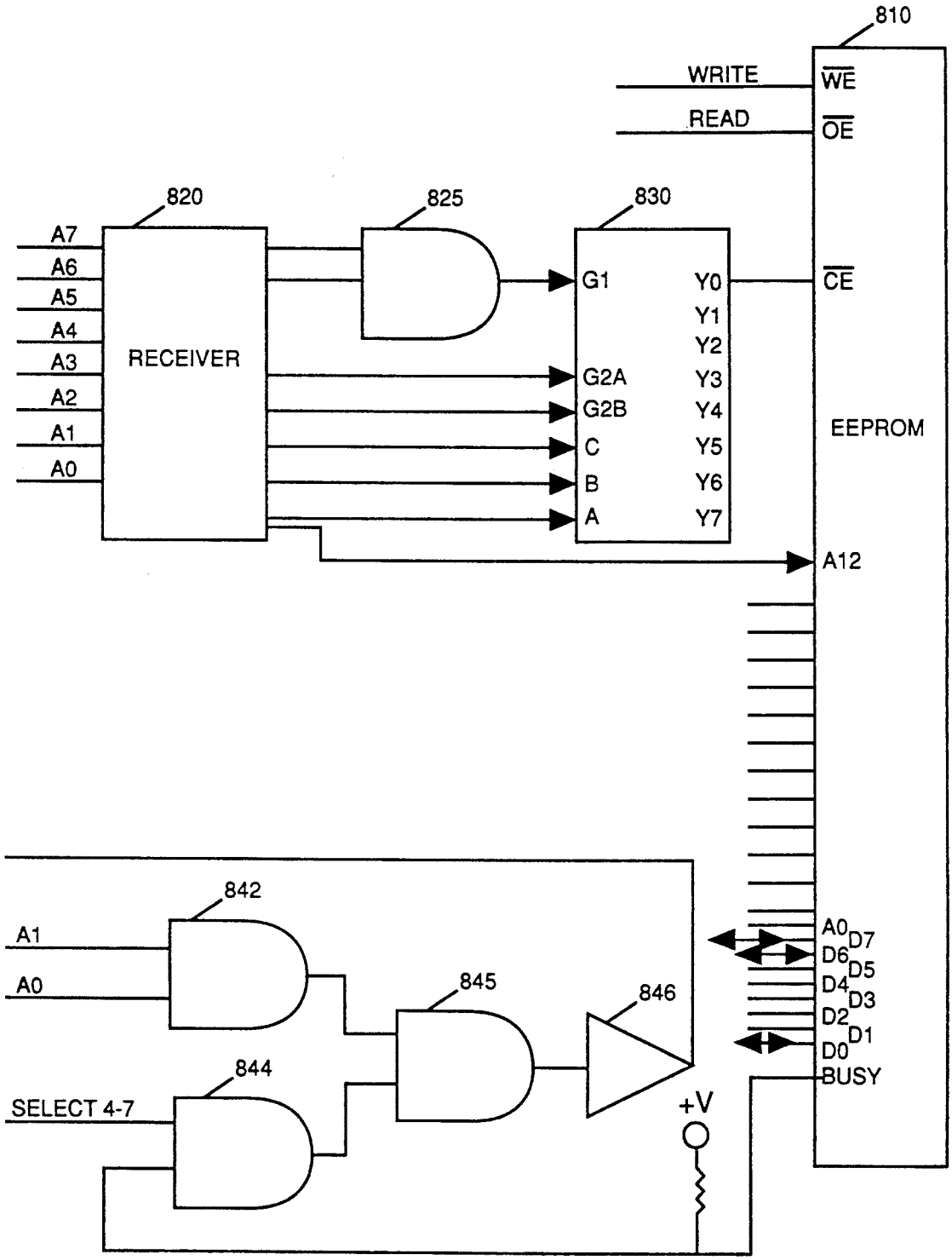
Figure 7D:
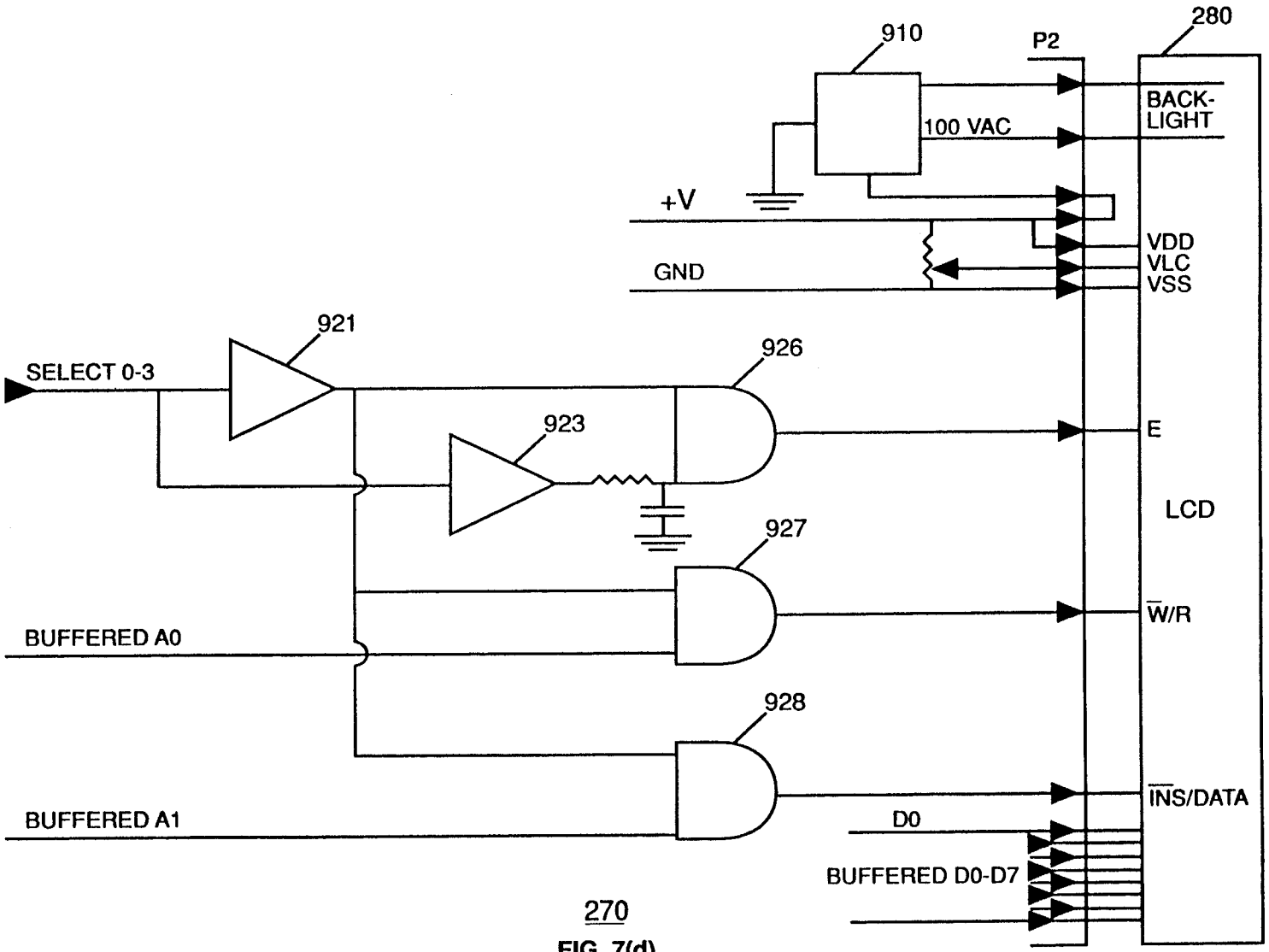

FIG. 6 is a schematic diagram of the interface 290 for the load cell 310 of the present invention. A load cell transducer bridge 510 consisting of four variable resistors arranged in a Wheatstone bridge configuration represents the output transducer of the load cell 310 connected to the components of the interface 290. A coarse adjustment resistor 520 and a fine adjustment resistor 525 are connected via resistors 528 and 529 to a reference input of amplifier 530. The amplifier 530 is preferably an analog devices AD624 amplifier, provides an output 615. Capacitors 535, 536, 537 and 538 are provided as illustrated to reduce noise and improve response characteristics. In voltage reference circuit 540, preferably an AD584 device provides a reference voltage under the control of a variable resistor 545. The reference voltage is provided to a transistor 550 via an operational amplifier 555 to the load cell transducer bridge 510.

FIG. 7(*a*) illustrates an interface to an analog to digital converter 610. The output 615 the amplifier 530 of the interface 290 connects to an analog input terminal of the analog to digital converter 610. Analog to digital converter 610 preferably can be constructed by an analog devices AD679 14-bit analog to digital converter chip. Digital data signals D0 through D7 are provided as an output from the analog to digital converter 610. The analog to digital converter 610 is controlled by clock and control signals Al, SELECT 8-B, buffered WRITE, buffered READ and A0 as illustrated in FIG. 7(*a*).

FIG. 7(*b*) illustrates interface circuitry of the interface board 250 for connection to the mother board 210 via an IBM ® expansion bus interface connector 710. Bidirectional data lines D0–D7 connect to the electronically erasable programmable read only memory 260 and the interfaces 270 and 290 via buffer chip 720. Furthermore, address lines A0–A7 connect from the IBM ® expansion bus interface connector 710 through buffer circuit 730 to the electronically erasable programmable read only memory 260 and the interfaces 270 and 290. Address lines A0 and A1 connect, specifically, to control the display interface 270 as will later be described with respect to FIG. 7(*d*). The address lines A2–A7 connect to latch circuits 740 and 750. Latch circuit 740 provides an output signal to a control gate 749. Other address lines A8 and A9 and other control signals from the IBM ® expansion bus interface connector 710 connect through buffer circuit 760 to circuit 740 and gates 762, 764 and 766 and also buffer 763. The output of gates 764 and 749 in response to the output of circuit 740 controls the switch circuit 750 to provide select signals. These select signals connect to each of the electronically erasable programmable read only memory 760 and the interface circuits 270 and 290. The switch circuit 750 is preferably an 74LS138 integrated circuit. The buffers 720, 730 and 760 are preferably 74LS245, 74LS244 and 74LS244 integrated circuits, respectively. Additionally, the switch circuit 740 is preferably a 74LS85 integrated circuit.

FIG. 7(*c*) illustrates a schematic diagram of the electronically erasable programmable read only memory 260 with interface thereto. An electronically erasable programmable read only memory 810, preferably a 26C65 integrated circuit providing addresses C0000 through C1FFF, is provided. Address lines A0–A7 are received by receiver chip 820. The receiver 820 is preferably a 74LS244 integrated circuit chip having outputs connected via an AND gate 825 to a decoder circuit 830. The decoder circuit 830 is preferably a 74LS138 integrated circuit for providing a chip enable input not CE to the electronically erasable programmable read only memory 810. Buffer READ and buffer WRITE signals from the buffer circuit 760 of the mother board 250 (FIG. 7(*b*)) are connected to write enable and read enable inputs not WE and not OE of the electronically erasable programmable read only memory 810. Data lines D0–D7 connect from the electronically erasable programmable read only memory 810 to the buffered data lines D0–D7 connected to the buffer chip 720 of FIG. 7(*b*). Furthermore, the buffered address lines A0 and A1 and the select signals and some of the select signals from the chip 750 in FIG. 7(*b*) connect to AND gates 842, 844 and 845 and buffer 846 illustrated in FIG. 7(*c*) to cooperate with the buffered data line D0. Furthermore, a not BUSY output of the electronically erasable programmable read only memory 810 connects to an input of the end gates 844 to provide the buffered data D0 output from amplifier 846 in response to the control of the select signals not SEL 4–7 and buffered address lines A0 and A1. When the pair of address lines A1 and A0 are both 0, data are written to the electronically erasable programmable read only memory 810. When the pair of address lines A1 and A0 are 0 and 1, respectively, then the electronically erasable programmable read only memory 810 is read from. When the pair of address lines A1 and A0 is 1 and 0, respectively, then a write instruction command is issued for the electronically erasable programmable read only memory 810. Furthermore, when the pair of address lines A1 and A0 is 1 and 1, a read busy flag is set for the electronically erasable programmable read only memory 810. FIG. 7(*d*) illustrates the interface 270 for the display 280. The display 280 is preferably a backlit LCD display powered by 100 volts AC from an inverter 910. Buffered signals not SELECT 0–3, buffered address line A0, and buffered address line A1, respectively, from the chip 750 and the chip 730 of FIG. 7(*b*) connect via buffers 921 and 923 and AND gates 926, 927 and 928 to E, not W/R and not INS/DATA inputs of the liquid crystal display 280.

Figure 8A:
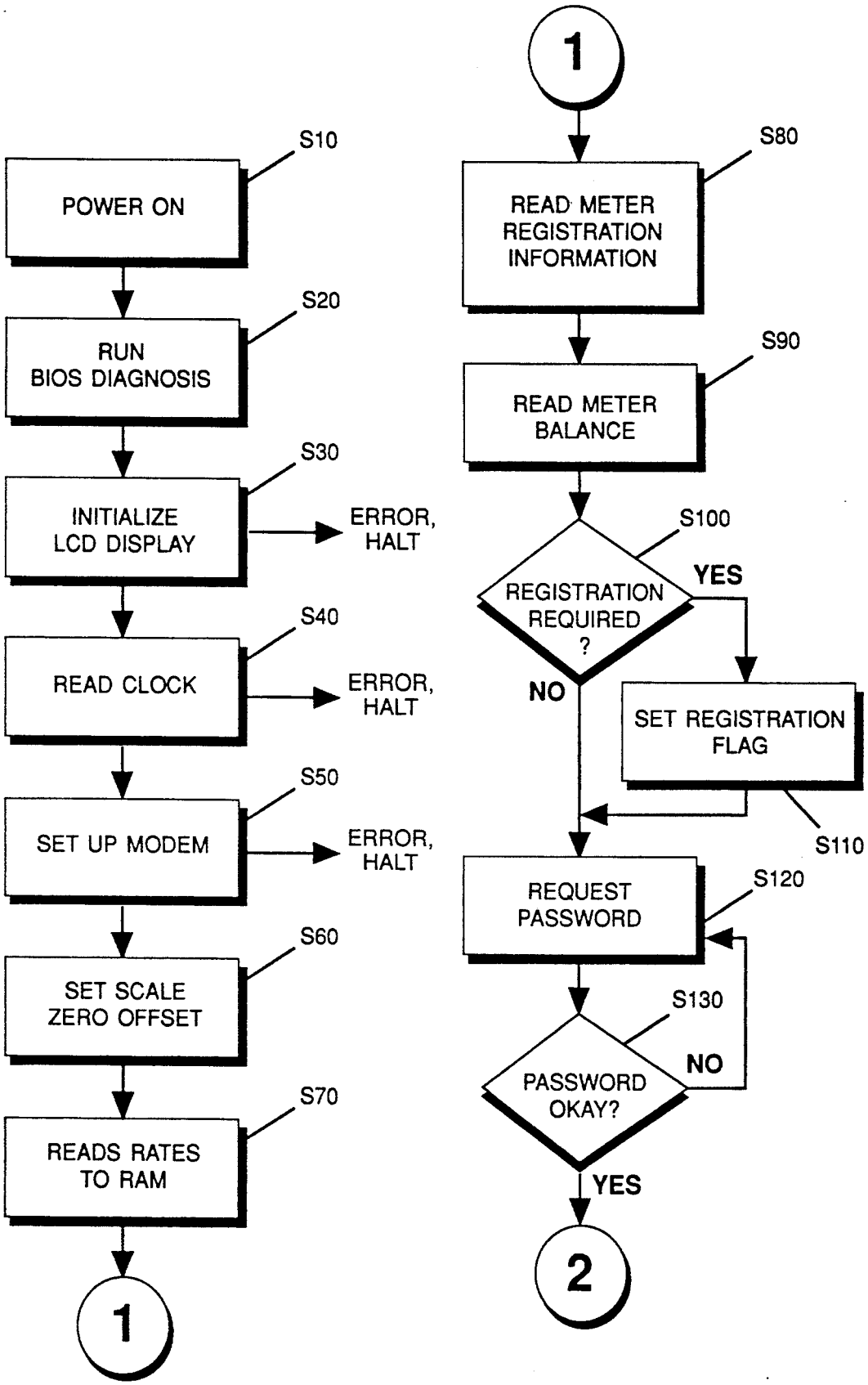
FIGS. 8(*a*) and 8(*b*) show a flow chart illustrating initialization and steady state measurement steps of the postage meter of the present invention.
Figure 8B:
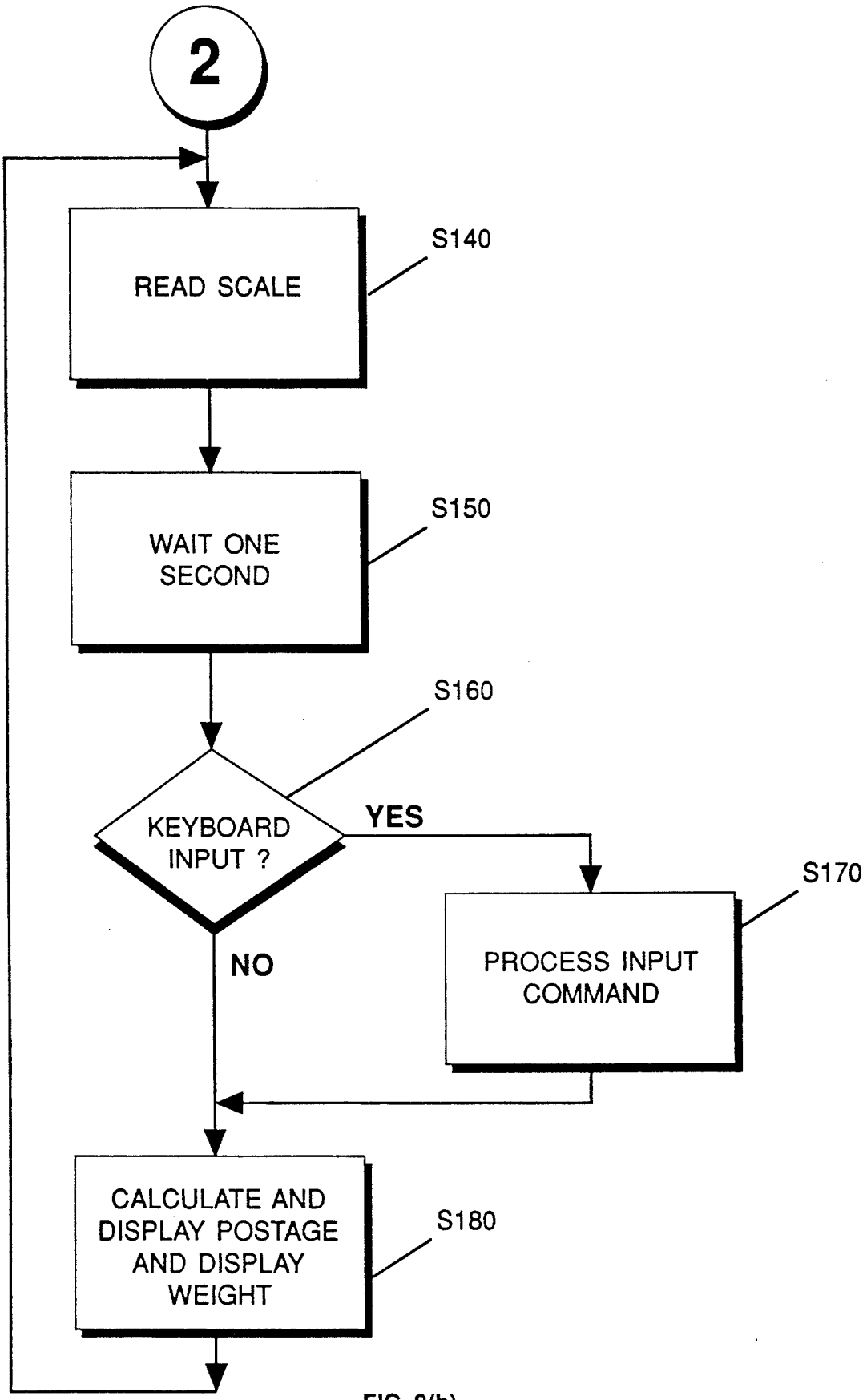

FIGS. 8(*a*) and 8(*b*) show a flow chart illustrating the method steps for execution by the central processing unit 220 for initialization and steady state operation of the postage meter. Upon powerup, step S10, a basic input/output system (BIOS) diagnostics routine step S20 is executed on the mother board 210 of the postage meter. The LCD display 280 is initialized by step S30, the clock 340 is read by step S40 and the modem 350 is initialized by step S50. Upon errors in each of these three steps S30, S40, and S50, operation is halted upon an error as illustrated in FIG. 8(*a*). The load cell 310 is set to a zero offset by step S60. Postage rates are stored in the random access memory 230 in step S70. Thereafter, meter registration information is read from one or both of the random access memory 230 and the read only memory 240 in step S80 illustrated in FIG. 8(*a*). Then, in step S90 the balance of an amount of postage resident in the postage meter is read from the ascending and descending registers stored in the electronically erasable programmable read only memory 260. In step S100 it is determined if re-registration is necessary. If re-registration is not necessary, flow proceeds to step S120. If re-registration is necessary, execution proceeds to step S110 where a re-registration flag is set. Thereafter, a password request is made on the display 280 in step S120. After input of the password on keyboard 300, the password is verified as correct in step S130. If the password is not correct, step S120 is executed again. If the password is correct in step S130, execution proceeds to the steady state loop illustrated in the flow chart of FIG. 8(*b*).

FIG. 8(*b*) shows a flow chart illustrating a steady state loop of operation of the postage meter of the present invention. The load cell 310 is read in step S140 and a one-second delay is executed in step S150 to allow stabilization of movement of the load cell 310. Then, if a keyboard input is received in step S160, the input on the keyboard 300 is processed by step S170. Otherwise flow proceeds directly to step S180. Thereafter, an amount of postage is calculated based on the rates read into the random access memory 230 in step S70 and the weight read by the load cell 310 in step S140. After step S180 flow returns to again read the scale in step S140. Thus in step S180, postage is dispensed from the postage meter by printing using the postal indicia printer 320.

Figure 9A:
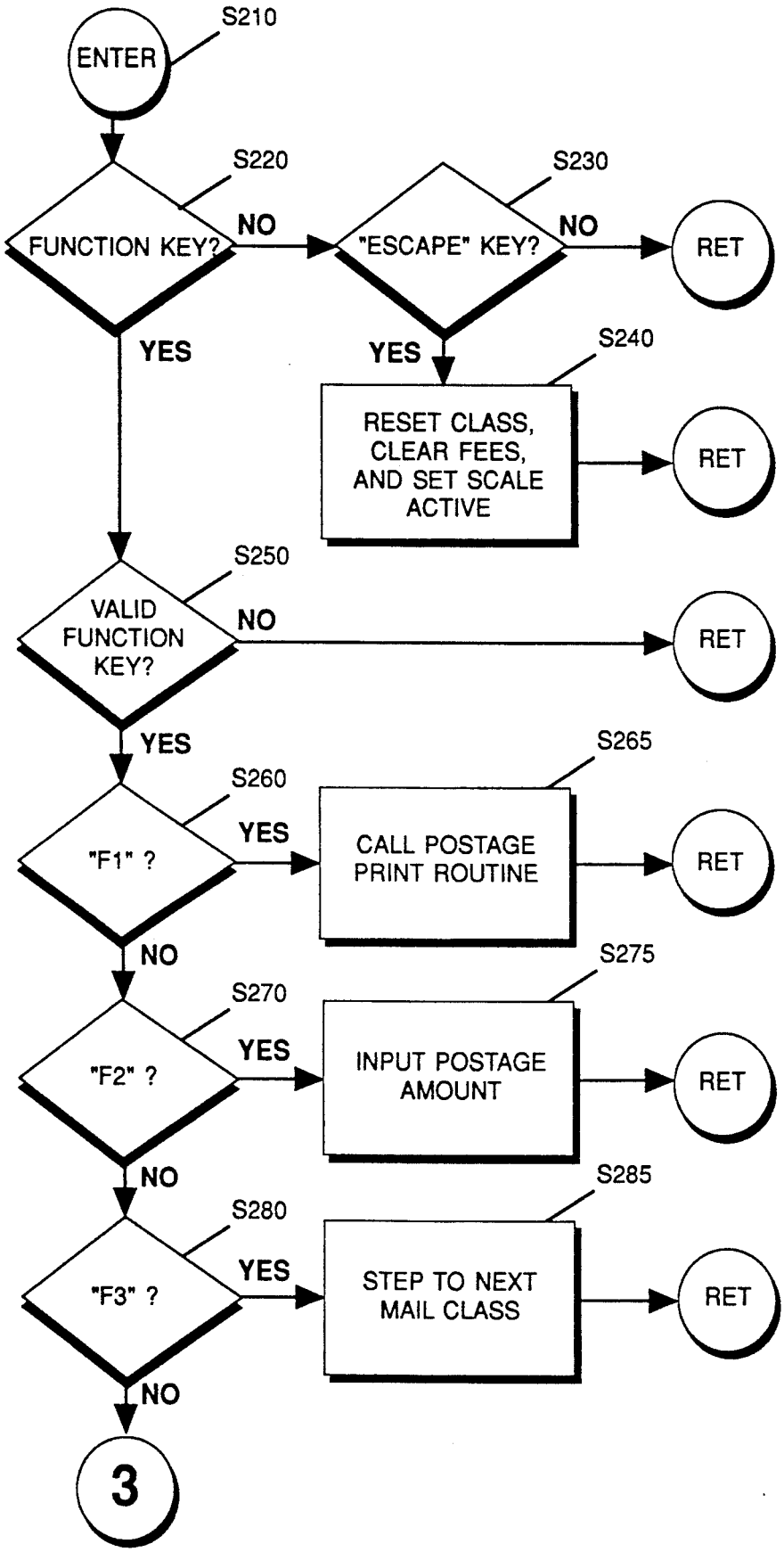
FIGS. 9(*a*), 9(*b*) and 9(*c*) show flow charts illustrating the execution of functions of the postage meter of the present invention based on keyboard input by a user of the postage meter of the present invention.
Figure 9B:
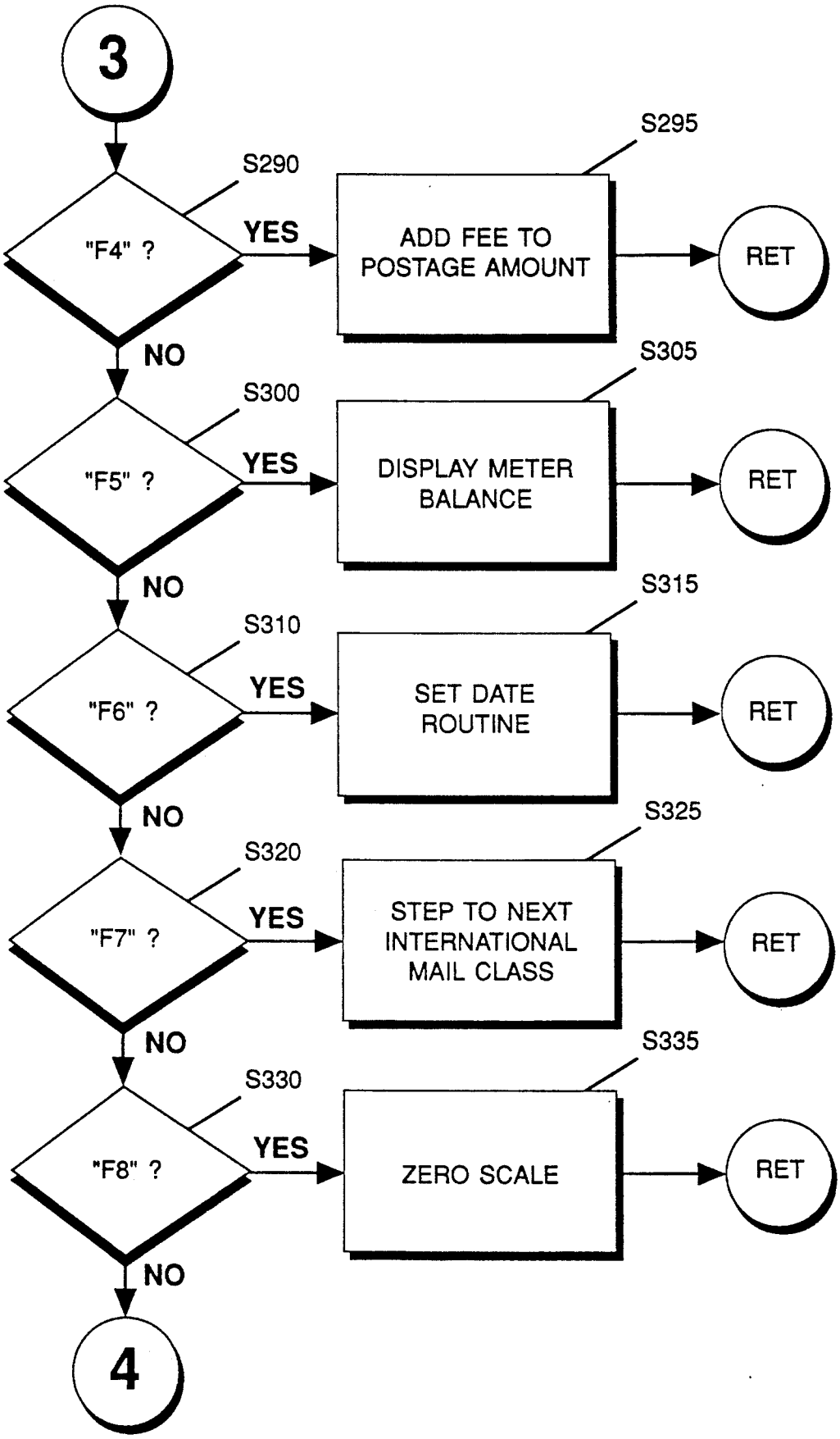
Figure 9C:
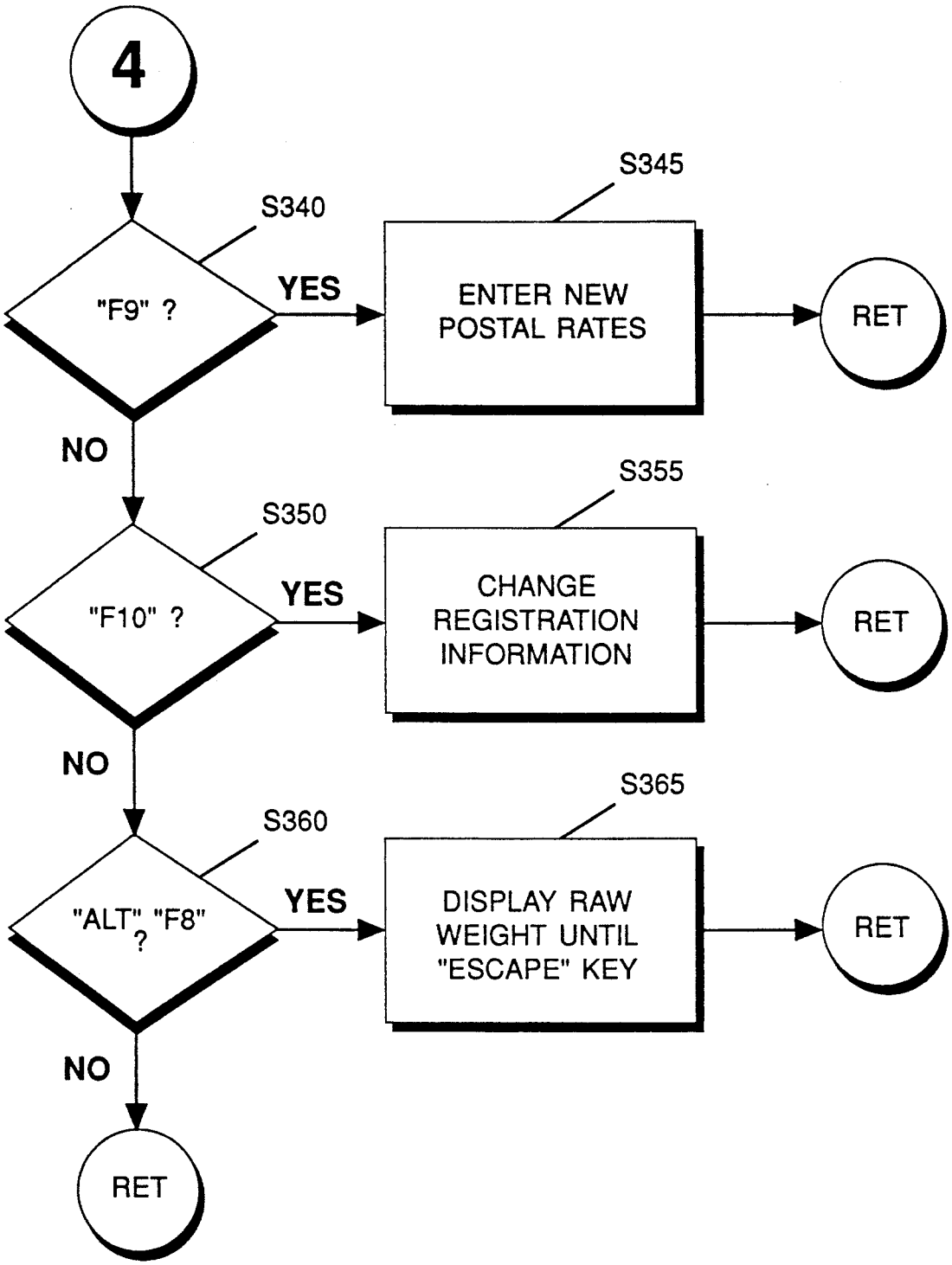

FIGS. 9(*a*) through 9(*c*) show flow charts illustrating various functions performed by the postage meter upon selection of function keys. After step S210, step S220 checks whether a function key has been depressed on the keyboard 300. If a function key has not been depressed on the keyboard 300, step S230 checks for depression of the "Escape" key. If the "Escape" key has not been depressed, flow returns back to step S210. However, if the "Escape" key has been depressed as detected in step S230, flow proceeds to step S240 where the postage class and the determined postage amount are reset and the scale is set active. If a function key is depressed, as determined by step S220, operation proceeds to step S250 where it is determined if a valid function key has been depressed. Then in steps S260, S270, S280, S290, S300, S310, S320, S330, S340, S350 and S360, the keys are successively checked for depression of a particular function key or function key combination. If a valid function key has not been depressed, flow returns back to step S210. Assuming a valid function key has been depressed, step S260 determines if the function key Fl has been depressed and executes step S265. Step S265 controls the postal indicia printer to dispense postage from the postage meter. When step S270 determines that the function key F2 has been depressed, step S275 waits for a postage amount to be input on the keyboard 300. When step S280 determines that the function key F3 has been depressed, step S285 changes the mail class by stepping through a predetermined sequence of mail classes.

When the function key F4 is depressed in step S290 of FIG. 9(*b*), step S295 is executed to add a fee to the postage amount. When the function key F5 is depressed in step S300, step S305 is executed to display the amount of postage in the electronically erasable programmable read only memory 260 on the display 280 as the postage meter balance. When the function key F6 is depressed in step S310, a routine is executed to set the date in step S315. When the function key F7 is depressed in step S320, an international class is selected in step S325 by stepping through a predetermined sequence of international mail classes by the depression of the function key F7. When function key F8 is depressed in step S330, the load cell 310 is calibrated or reset to zero by step S335.

When the function key F9 is depressed in step S340 of FIG. 9(*c*), step S345 is executed to allow an input of new postal rates into the postage meter. The new postal rates can be input manually on the keyboard or, alternatively, downloaded from the manufacturer host 200 via the modem 350. When the function key F10 is depressed in step S350, the registration or licensing information is changed or updated in step S355. Meter licensing information can be loaded or changed which includes the name, street address and telephone number of the licensee, the address and telephone number at which the electronic postage meter is located, and the name and address of the post office, station, or branch which is to supervise the postage meter. The meter licensing information changed in step S355 can also include the user's credit number or numbers and date of expiration or even debit card numbers for the user. Furthermore, it can also include the telephone number that the postage meter will automatically dial via the modem 350 in order to purchase new postage by credit card number or debit card transaction. In step S355 the electronic postage meter can be remotely licensed or registered into service, have its license renewed or be relicensed via the keyboard 300 and display 280 under control of the central processing unit 220 based on a program in the read only memory 240. For licensing or registering into service, the user or licensee of the postage meter is prompted to enter licensing information, such as described above, via keyboard 310. Thereafter, the modem 350 of the postage meter will automatically dial a preprogrammed telephone number. This preprogrammed telephone number can be the same telephone number of the manufacturer host as required for an authorization of an increase in an amount of postage resident in the postage meter. When the manufacturer host 200 receives a request for remote licensing or registration, the manufacturer host can connect to a host of, for example, the New York Postal Data Center, which is a repostory of meter licensing data. Furthermore, in step S355 passwords can be stored or changed for the postage meter.

When the function key ALT F8 is depressed in step S360, a raw weight is displayed in step S365 on the display 280 until the "Escape" key is depressed. After steps S240, S265, S275, S285, S295, S305, S315, S325, S335, S345, S355 and S365 flow returns back to step S210.

Figure 10:
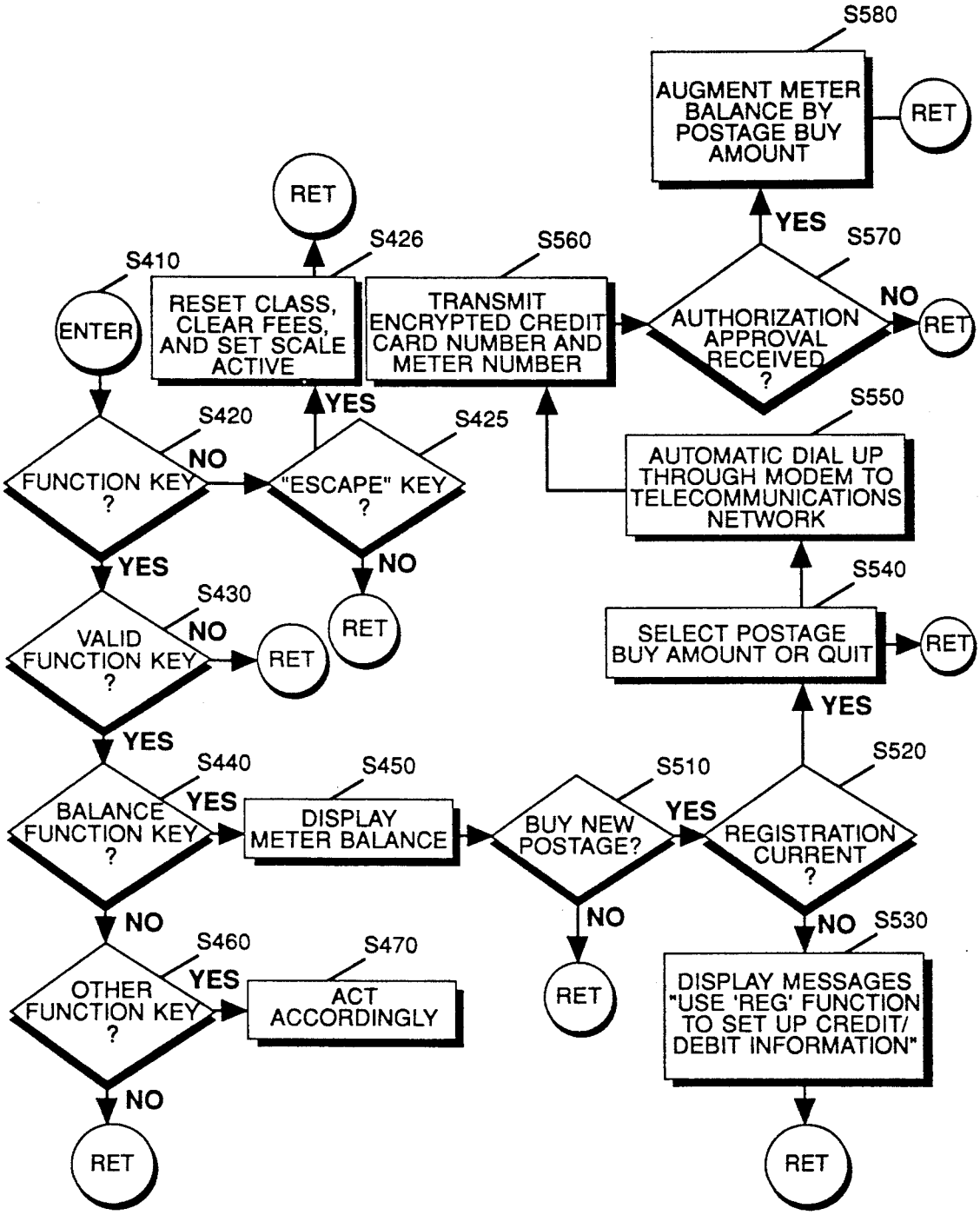
FIG. 10 shows a flow chart illustrating steps of the postage meter of the present invention for remotely recharging an amount of money in the postage meter.

FIG. 10 shows a flow chart illustrating steps of the postage meter of the present invention for remotely recharging an amount of postage in the postage meter. After step S410, step S420 checks whether a function key has been depressed on the keyboard 300. When a function key is depressed as identified in step S420, step S430 determines whether the function key is a valid function key. If a function key has not been depressed in step S420, step S425 determines if an escape step has been conducted and if so, the logic goes to step S426, reset and return, or if not, it goes directly to return. If step S430 determines that the function key is not valid, flow returns to step S410. Otherwise, if step S430 determines that the function key is valid, flow continues to step S440. Step S440 determines whether a balance function key has been depressed. If the balance function key has been depressed, the amount of postage or balance resident in the postage meter is displayed on the display 280 in step S450. If the balance function key has not been depressed, flow continues to step S460. If an additional function key is depressed as determined by step S460, other functions are executed as represented by step S470. Steps S460 and S470 can correspond to steps S260, through S360 illustrated in FIGS. 9(*a*) through 9(*c*). If an additional function key is not depressed as determined by step S460, flow returns to step S410.

After the amount of postage or balance resident in the postage meter is displayed by step S450, step S510 determines if a new amount of postage shall be purchased. If a new amount of postage shall not be purchased as determined in step S510, flow returns to step S410. If a new amount of postage shall be purchased as determined in step S510, step S520 determines if the registration information for the meter is current. For example, periodic registrations of the meter are necessary to ensure the meter is still in the hands of an original licensee as required by Postal Service regulations. If the registration information is not current as determined in step S520, step S530 automatically provides for registration or licensing of the meter via the modem 350 and returns flow to step S410. Relicensing of the meter is described above, for example, in conjunction with step 355. If the registration information is current as determined in step S520, step S540 is executed.

In step S540 the user is prompted on display 280 to input a desired amount of postage to purchase on the keyboard 300. After the amount of postage desired to be purchased is entered in step S540, the postage meter 100 automatically dials the manufacturer host 200 by the modem 350 over an ordinary telephone communication line in step S550. The telephone number dialed by the modem 350 in step S550 is a telephone number that the user has already entered into the memory of the postage meter. Then the modem 350 of the postage meter transmits an encrypted credit card number and meter number to the manufacturer host 200 in step S560. Thereafter, the postage meter waits at step S570 for receipt of an authorization approval by modem 350 from the manufacturer host. The manufacturer host 200 sends an authorization approval to the postage meter when the manufacturer host confirms that the account number of the credit card is creditworthy. In step S560 the amount of new postage selected in step S540 and/or an expiration date for the credit card can also be transmitted. As an alternative to a credit card number transmitted in step S560, a debit card account number can be alternatively transmitted for payment of postage. When the postage meter receives an authorization approval from the manufacturer host 200 in step 570, the amount of balance of money in the electronic erasable programmable read only memory 260 is increased in step S580 by the amount determined in step S540. If the manufacturer host 200 denies authorization, step 570 will display a message to that effect and return to step S410. Additionally, if authorization is denied, the postage meter may be programmed to make a permanent record of the denial in the nonvolatile memory such as electronically erasable programmable read only memory 260 to deter tampering or fraud.

Figure 11:
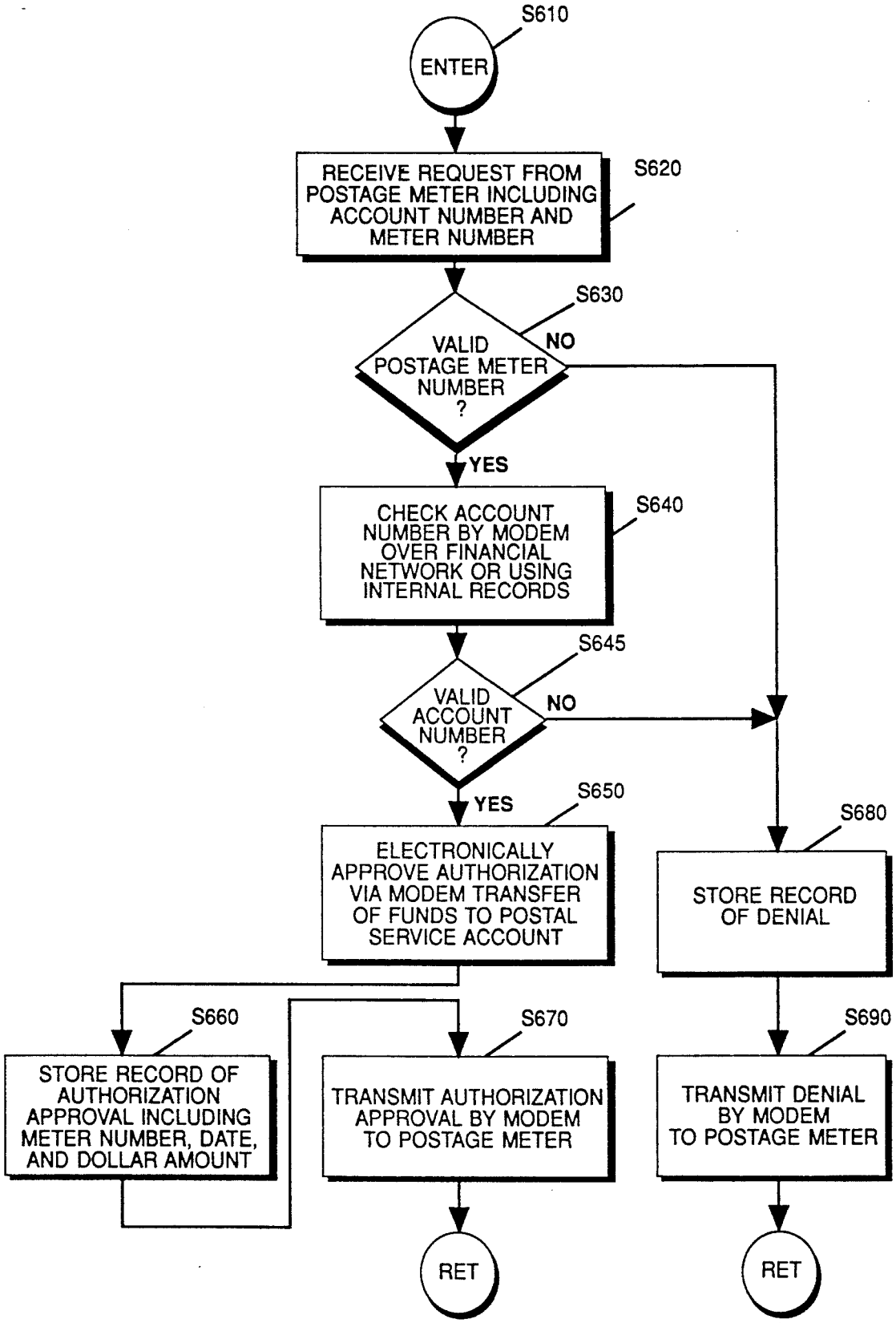
FIG. 11 shows a flow chart illustrating steps performed by the manufacturer host of the present invention.

FIG. 11 shows a flow chart illustrating steps performed by the manufacturer host of the present invention. After step S610, in step S620 the manufacturer host receives via modem 210 a request from the postage meter 100 which includes an account number and the postage meter number. Then, in step S630, the manufacturer host 200 searches a list of valid meter numbers in register 230 to determine if the postage meter number is valid. If the postage meter number is valid in step S630, the account number is checked in step S640. In the embodiment corresponding to FIG. 2, the account number is checked by modem on line 260 over a financial network such as a credit card service company 310. In an alternative embodiment such as, for example, FIG. 3, the account number is checked using account information stored in the manufacturer host. Step S645 determines if the account number is valid or creditworthy based on the results of step S640 and, if the account number is valid or creditworthy, proceeds to step S650. In step S650, the manufacturer host 200 electronically authorizes via modem a transfer of funds to a Postal Service bank account 340. Then, in step S660, the manufacturer host stores in a transaction history data register 240 a record of an authorization to increase an amount of funds in the postage meter. In the transaction history data memory 240 the stored record includes the meter number, the date of the transaction and a dollar amount of the transaction. Then, in step S670, the manufacturer host 200 transmits an authorization approval to the postage meter 100 via modem 210. The authorization preferably is encrypted and can include information such as, for example, the dollar amount or an authorization code. Then, when the postage meter receives the authorization from step S670, the amount of money indicated in the nonvolatile register 160 is increased.

Should the manufacturer host 200 determine in step S640 and S645 that the account number is invalid or determine in step S630 that the postage meter number is invalid, a record of detail of the request to increase the amount of postage is stored in the transaction history data memory 240 of the manufacturer host by step S680. Then in step S690 the manufacturer host transmits a denial to the postage meter via modem 210 over an ordinary telephone transmission line.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

What is claimed is:

1. A system for recharging a postage meter, comprising a plurality of postage meters, each postage meter comprising a central processor unit;

constant nonvolatile register means for indicating to said central processor unit a predetermined postage meter number fixedly assigned to the postage meter;

nonvolatile register means for indicating to said central processor unit and for storing from said control processor unit an amount of postage resident in the postage meter;

account number register means for indicating to said central processor unit and for storing from said central processor unit at least one credit card number; and meter modem means responsive to said central processor unit for transmitting the credit card number and the postage meter number to request an increase in the amount of postage resident in the postage meter; and a manufacturer host comprising host modem means for communication with at least said postage meter;

meter number register means for storing a plurality of valid postage meter numbers; and host processor means for receiving via said host modem a credit card number and a postage meter number from a postage meter requesting an increase in an amount of postage, for verifying that the postage meter number is among the valid postage meter numbers stored in said meter number register means, for verifying from validity and creditworthiness records that the credit card number is valid and creditworthy and for transmitting an authorization approval via said host modem to increase the amount of postage.

2. A system according to claim 1, wherein said manufacturer host further comprises transaction memory means for storing a record of authorization approvals transmitted to increase the amount of postage; and wherein said host processor means automatically authorizes, via said host modem means, an electronic transfer of funds to a Postal Service bank account, said electronic transfer occurring at predetermined intervals based upon the record of transactions stored in said transaction memory means.

3. A system according to claim 1, wherein said host processor means automatically authorizes, via said host modem means, an electronic transfer of funds to a Postal Service bank account on a real time basis after transmission of the authorization approval to increase the amount of postage.

4. A system according to claim 1, wherein said postage meter further comprises a credit card reader operatively connected to said central processor unit to store a credit card number in said account number register means.

5. A system according to claim 1, wherein said account number register means further stores an expiration date corresponding to each credit card number.

6. A system according to claim 1, wherein said manufacturer host further comprises a transaction memory means for storing a record of authorization approvals transmitted to increase the amount of postage and for storing the credit card number corresponding to each authorization approval.

7. A system according to claim 1, wherein said constant nonvolatile register means comprises a read only memory; and wherein said nonvolatile register means comprises an electronically erasable programmable read only memory.

8. A system according to claim 1, wherein each said postage meter further comprises:

a display, a keypad, a load cell, and a postal indicia printer, each operatively connected to said central processor unit.

9. A system according to claim 1, wherein said manufacturer host further comprises credit card creditworthiness memory means for storing records indicative of the creditworthiness of credit card numbers.

10. A system according to claim 9, wherein said manufacturer host further comprises a transaction memory means for storing records of the authorization approvals transmitted to increase the amount of postage in a postage meter and the credit card number associated with each authorization; and wherein said host processor means at predetermined intervals transmits to a billing computer via said host modem means the transaction records stored in said transaction memory means.

11. A system according to claim 1, wherein said host processor means verifies that the credit card number is valid and creditworthy by transmitting the credit card number, via the host modem means, to a credit card service company and receiving from the credit card service company, via the host modem means, an authorization approval that an account of the credit card number is valid and creditworthy.

12. A system according to claim 11, wherein said host processor means automatically authorizes, via said host modem means, an electronic transfer of funds to a Postal Service bank account in real time after the credit card service company verifies the creditworthiness of the account of the credit card number.

13. A system according to claim 11, wherein said host processor means further receives a credit authorization approval code word over the financial network from the credit card service company to confirm the creditworthiness of the account corresponding to the credit card number.

14. A system according to claim 13, wherein said account number register means of said postage meter stores an expiration date corresponding to the credit card number;

wherein said meter modem means of said postage meter transmits a credit card expiration date and the credit card number to the manufacturer host to request an increase in the amount of postage; and wherein said manufacturer host further comprises a transaction memory means for storing a record of transactions including the credit card number, the credit card expiration date, and the authorization approval code received via the host modem means from the credit card service company.

15. A postage meter capable of remote recharging by communication with a host, comprising:

a central processor unit;

a constant nonvolatile register operatively connected to said central processor unit to indicate a predetermined meter number fixedly assigned to the postage meter;

a nonvolatile register operatively connected to said central processor unit to store and indicate an amount of postage resident in the postage meter;

an account number register operatively connected to said central processor unit to store and indicate at least one credit card number; and a modem operatively connected to said central processor unit to transmit the credit card number and the postage meter number to the host to request an increase in the amount of postage resident in the postage meter and to receive an authorization from the host that the account number is valid and creditworthy.

16. A postage meter according to claim 15, wherein said postage meter further comprises a credit card reader operatively connected to said central processor unit to store a credit card number in said account number register.

17. A postage meter according to claim 15, wherein said account number register of said postage meter further stores an expiration date corresponding to the credit card number; and wherein said modem transmits a credit card expiration date and a credit card number to the host to request an increase in the amount of postage.

18. A system according to claim 15, wherein each said postage meter further comprises:

a display, a keypad, a load cell, and a postal indicia printer, each operatively connected to said central processor unit.

19. A postage meter according to claim 15, wherein said constant nonvolatile register and said nonvolatile register are encased in a first housing; and wherein said central processor unit is encased in a second housing of a personal computer, the second housing separate from the first housing and capable of connection to said first housing.

20. A method of recharging a postage meter, comprising the steps of:

(a) transmitting from a modem of a postage meter to a host credit card number and a postage meter number to request an increase in the mount of postage resident in a nonvolatile register of the postage meter;

(b) receiving in the host the credit card number and the postage meter number from the postage meter requesting an increase in an amount of postage;

(c) searching a list of valid postage meter numbers stored in a register of the host to confirm that the postage meter number is valid;

(d) verifying that the credit card number is valid and creditworthy; and (e) transmitting via the modem an authorization approval from the host to the postage meter to increase the amount of postage in the nonvolatile register of the postage meter when the postage meter number is confirmed as valid in said step (c) and the credit card number is verified as valid and creditworthy in said step (d).

21. A method according to claim 20, further comprising the step of:

(f) storing in a transaction memory in the host a record of authorization approvals transmitted to increase the amount of postage; and (g) automatically authorizing from the host via a modem an electronic transfer of funds to a Postal Service bank account, said electronic transfer occurring at predetermined intervals of time based upon the record of transactions stored in the transaction memory.

22. A method according to claim 20, further comprising the step of:

(f) automatically authorizing, from the host via a modem, an electronic transfer of funds to a Postal Service bank account on a real time basis after transmission of the authorization approval to increase the amount of postage in said step (e).

23. A method according to claim 20, wherein said step (d) further comprises the steps of:

(d1) transmitting the credit card number from the host via a modem to a credit card service company; and (d2) receiving from the credit card service company via the modem an authorization approval that an account of the credit card number is creditworthy.

24. A method according to claim 20, wherein said step (d) further comprises the step of:

(d1) searching in the host records indicative of the creditworthiness of credit card numbers to verify that an account of the credit card number is creditworthy.

25. A method according to claim 24, further comprising the steps of:

(f) storing a transaction memory records of the authorization approvals transmitted to increase the amount of postage in said step (e) and storing the credit card number associated with each authorization approval; and (g) from time to time transmitting via a modem from the host to a billing computer the transaction records stored in the transaction memory in said step (f).

* * * * *